US007766153B2

(12) United States Patent
Brugger et al.

(10) Patent No.: US 7,766,153 B2
(45) Date of Patent: Aug. 3, 2010

(54) FLAT TRAY CARTONER

(75) Inventors: Jerome Brugger, Melbourne, KY (US); Matthew R. Lukes, Independence, KY (US)

(73) Assignee: R.A. Jones & Co. Inc., Crescent Springs, KY (US)

( * ) Notice: Subject to any disclaimer, the term of this patent is extended or adjusted under 35 U.S.C. 154(b) by 241 days.

(21) Appl. No.: 12/046,518

(22) Filed: Mar. 12, 2008

(65) Prior Publication Data

US 2008/0223690 A1 Sep. 18, 2008

Related U.S. Application Data

(60) Provisional application No. 60/894,299, filed on Mar. 12, 2007.

(51) Int. Cl.
*B65G 47/24* (2006.01)

(52) U.S. Cl. ..... 198/416; 198/457.05; 198/367; 53/259

(58) Field of Classification Search ..... 198/456, 198/457.01, 457.05, 599, 416, 367; 53/251, 53/259

See application file for complete search history.

(56) References Cited

U.S. PATENT DOCUMENTS 3,166,181 A * 1/1965 Rutkus et al. ..... 198/457.01
4,173,274 A * 11/1979 Kantarian et al. ..... 198/367
5,052,544 A * 10/1991 Anderson ..... 198/456
6,374,987 B1 * 4/2002 Heuft et al. ..... 198/416
6,993,889 B2 * 2/2006 Ford et al. ..... 53/251

* cited by examiner

*Primary Examiner*—James R Bidwell
(74) *Attorney, Agent, or Firm*—Wood, Herron & Evans, LLP

(57) ABSTRACT

Trays are indexed at predetermined pitch on a tray conveyor. As the trays are conveyed, a turning guide engages a leading tray portion, turning the tray and urging it transversely downward and/or into buckets on an adjacent bucket conveyor or cartons on an adjacent carton conveyor. A cam is disposed rearward of each tray on the tray conveyors and the turning trays pivot about that cam. A hold-down prevents trays climbing over the turning guide. Pressure relief and tray indexing are provided upstream of the tray conveyor. Apparatus and methods are disclosed.

17 Claims, 27 Drawing Sheets

FLAT TRAY CARTONER

FIELD OF THE INVENTION

This invention relates to cartoning and more particularly to apparatus and methods for controlling elongated flat trays containing product as they are conveyed for insertion into a carton.

BACKGROUND OF THE INVENTION

The particular parameters of products to be cartoned place a host of varied demands on a cartoner. It is known to feed single or grouped product into buckets in a cartoner and to push the products from the buckets into erected cartons moving alongside the product bucket. However, variations in product delivery orientation, feed rate, flow direction, product size, product shape, packing orientation with respect to the carton parameters and flow or throughput speed all must be considered. A variation in any one of these parameters may render a cartoner unfit for cartoning where one of these parameters differs from that for which the cartoner is designed.

Delivery and insertion of flat trays into cartons presents unique cartoning parameters. Such flat thermo-formed trays for single-serve frozen foods or "T.V. dinners" are but one example of an elongated flat tray, typically sealed over with a clear plastic film or lid, and bearing a food product, which are to be placed each in a single carton of rectangular shape conforming generally in size, but not necessarily in shape, to the tray. Such trays are typically of semi-elliptical shape with opposed narrow blunt ends.

Cartons are preferably supplied to the cartoner in blank form, erected with at least one open end for receiving the tray, then closed, sealed and discharged. Where the cartons are erected and transported downstream alongside product buckets, the cartons are oriented such that their width dimension is oriented parallel to their downstream motion, and their longer length dimension is perpendicular to the downstream or machine flow direction.

Where the elongated trays are fed into the cartoner end-to-end with their elongated length parallel to the machine flow, i.e. with a narrow blunt end leading, and their width or sides extending between the blunt ends perpendicular thereto, the trays must be turned 90° so they can be pushed perpendicularly to the machine flow, blunt end first, into the open carton ends.

Positive indexing and turning of the trays while maintaining them under positive control presents handling obstacles, particularly at the high flow rates or throughputs desired in excess of 200 trays per minute and preferably at least 240 to 260 trays per minute and up to 300 trays cartoned per minute. It is desired to minimize changes in velocity and direction of the trays through the process at these speeds and to reduce tray damage during cartoning.

Accordingly, it is objective of the invention to provide improved apparatus and methods for cartoning flat trays.

Another objective of the invention has been to provide apparatus and methods for receiving abutting flat trays and indexing them for cartoning.

Another objective of this invention has been to provide apparatus and methods for turning flat trays for orientation in provided buckets for feeding adjacent cartons.

Another objective of the invention has been to provide methods and apparatus for cartoning flat, elongated trays at speeds in excess of 200 trays per minute while positively controlling the trays through carton insertion.

Another objective of the invention has been to provide apparatus and methods for receiving flat trays in end-to-end relation, indexing the trays and turning the trays for insertion into cartons.

A further objective of the invention is to transport an elongated, narrow end leading product into a cartoner station in a relatively straight machine flow vector or direction and to minimize the forces necessary to turn the product to an orientation with a broad side leading in the machine flow direction for transverse insertion into a carton with narrow end leading.

To these ends, the invention in one embodiment receives elongated flat trays in abutting narrow-end-to-narrow-end relation, indexes or spaces those trays for alignment between spaced product lugs of a first conveyor, engages a forward corner portion of the narrow tray end with a turning guide or cam, turns the trays about a pivot area on a trailing lug while urging the tray with the turning guide into a product bucket on a second conveyor, and thereafter pushing the trays from the buckets into cartons on an adjacent conveyor.

Elongated trays are delivered primed on a low pressure infeed conveyor. Pressure relief and/or metering apparatus, such as rotating star wheels or indexing belts control tray delivery onto a tray conveyor carrying the spaced lugs at a correct tray pitch. An optional hold-down guide oriented above the tray path prevents trays from climbing over the turning guide. The configuration of the turning guide acting on the trays is sufficient to gently introduce the trays into the adjacent cartoner bucket conveyor without need for additional transfer devices.

Preferably, the product buckets each have a leading wall tapered or inclined in rearward direction toward a rearward wall to define a wide bucket mouth and thus facilitate product indexing and turning product entry into the bucket.

These and other objectives, advantages and alternatives will be readily appreciated from the following detailed description and from the drawings in which:

BRIEF DESCRIPTION OF THE DRAWINGS

The accompanying drawings, which are incorporated in and constitute a part of this specification, illustrate embodiments of the invention and, together with a general description of the invention given above and the detailed description given below, serve to explain the invention.

FIG. 2 is a perspective view showing the tray and bucket conveyors with the tray hold-down raised for clarity;

FIG. 3 is a view similar to FIG. 2, but showing the tray hold-down in operative position;

FIG. 4 is a plan view of features of the invention of FIG. 3;

FIG. 5 is a perspective view of the invention, showing frozen food trays moving therethrough, turning and loading into buckets;

FIG. 6 is a perspective view similar to FIG. 5 but from a closer perspective;

FIG. 7 is a perspective view similar to FIG. 6 but closer still;

FIG. 8 is a perspective view with the tray hold-down raised for clarity and illustrates both the tray size and the tray conveyor features with one tray manually and momentarily lifted out of position for clarity;

FIG. 9 is a perspective view similar to FIG. 8, from a slightly removed perspective;

FIG. 10 is a plan view illustrating the tray hold-down over the trays as they are turned and introduced into buckets;

FIG. 11 is a perspective view with the hold-down raised for clarity and showing trays turning and loading into buckets;

FIG. 12 is a perspective view similar to FIG. 11 but at the downstream end of the turning guide;

FIG. 13 is a plan view of the downstream end of the turning guide, and with the tray hold-down removed for clarity;

FIG. 14 is a perspective view of the invention showing indexing of the trays onto the tray conveyor by star wheels with tray hold-down removed for clarity;

FIG. 15 is a perspective view of the invention showing the spacing of trays by the opposed star wheels, showing the tray hold-down in operative position;

FIG. 16 is a plan view over the indexing stars showing trays moving left to right from a tray prime area to an indexed position on the tray conveyor, but with the tray hold-down removed for clarity;

FIG. 17 is a plan view similar to FIG. 16 but with the tray hold-down in operative position;

FIG. 19 illustrates diagrammatically the tray hold-down over the trays on the tray conveyor;

FIGS. 20-21 illustrate the tray turning and loading by the turning guide and with the tray hold-down removed for clarity;

DETAILED DESCRIPTION

Figure 1:
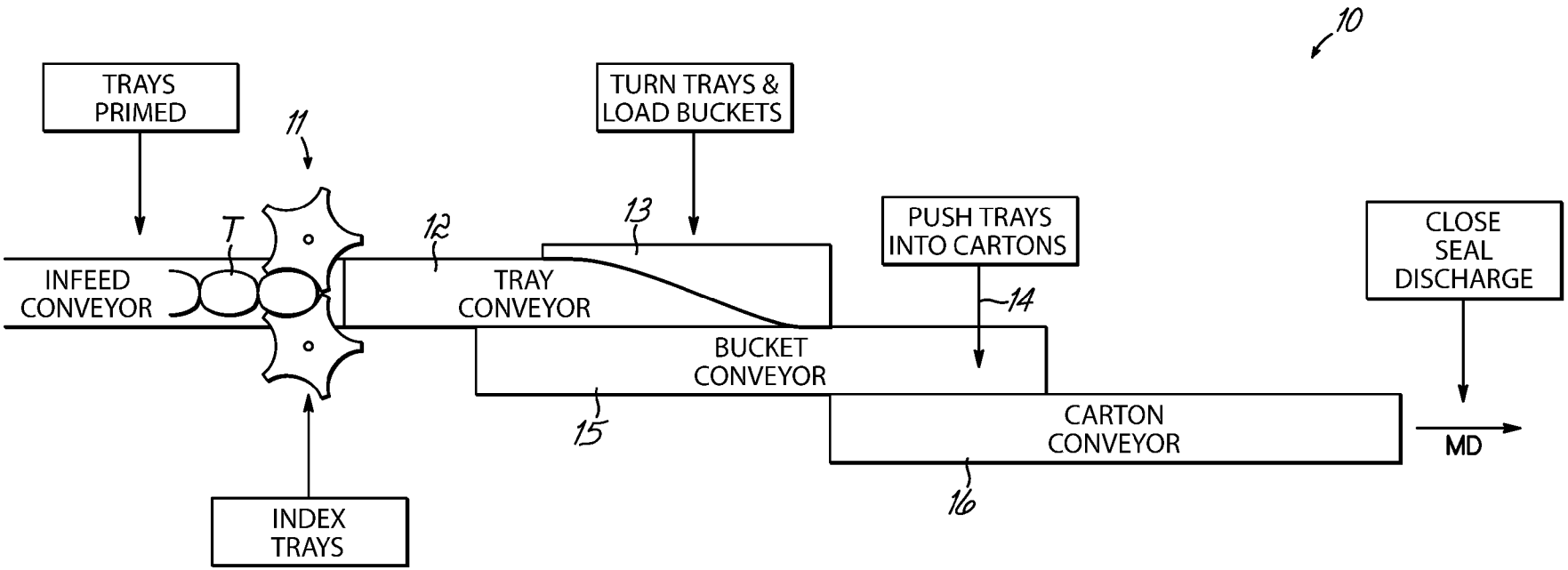
FIG. 1 is a diagrammatic plan view of one embodiment of the invention.

The overall invention 10 is illustrated in FIG. 1, where trays T are primed on the left end of the figure on a low pressure infeed conveyor. Star wheels 11 both relieve pressure from the "prime" and index trays at predetermined pitch onto a tray conveyor 12. Trays are conveyed in a first direction (machine direction arrow MD) toward a turning guide 13. Guide 13 turns the trays and pushes them in a second direction 14, perpendicular to direction MD, into buckets on a bucket conveyor 15. Trays are conveyed in buckets on conveyor 15 in direction MD from where they are further pushed into open ends of cartons, moving in a direction MD on a carton conveyor 16 adjacent the bucket conveyor 15. The cartons are then closed, sealed and discharged.

Trays T as described above, may be of somewhat varied shape and size but are preferably relatively flat and are elongated or oblong as shown with opposed narrow ends and elongated edges extending therebetween.

Figure 1A:
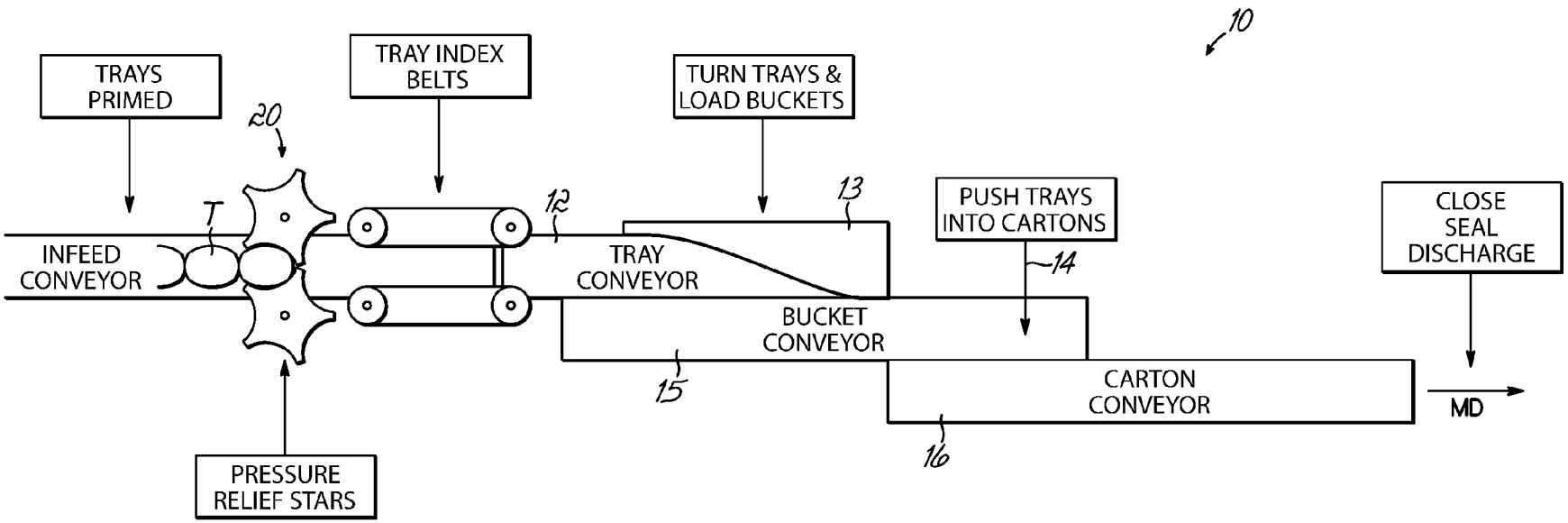
FIG. 1A is a diagrammatic plan view of a first alternative embodiment of the invention.

In an alternate embodiment shown in FIG. 1A the invention is similar except at the "prime" end on the left side of the Figure where star wheels 20 serve to relieve pressure on a leading tray from the following prime. Tray index belts as shown are used downstream to index and introduce trays onto the tray conveyor in predetermined pitch between leading and trailing lugs on the tray conveyor.

Figure 1B:
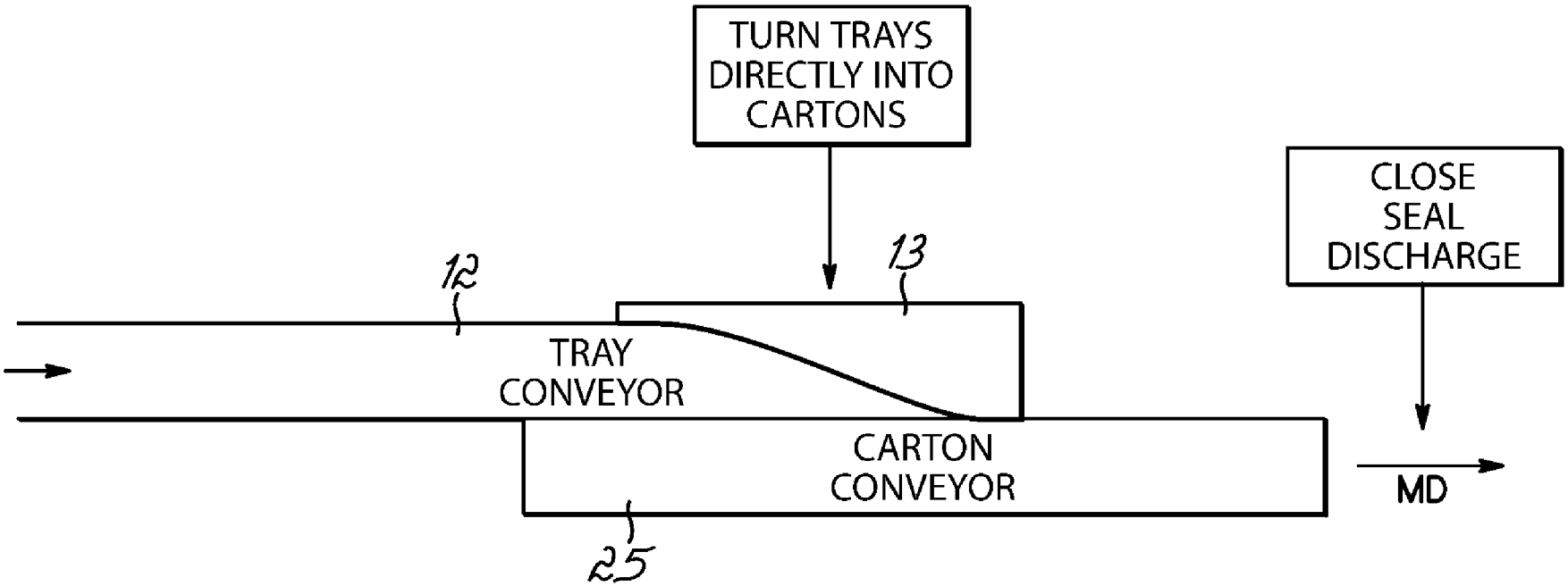
FIG. 1B is a diagrammatic plan view of a second alternate embodiment of the invention.

In a yet further alternate embodiment illustrated in FIG. 1B, the apparatus and operation upstream of the tray conveyor is as in FIG. 1 or 1A, for example. However, in this embodiment, there is no bucket conveyor. Instead, a carton conveyor 25 is operably disposed adjacent the tray conveyor. The turning and pushing or loading motion imparted by turning guide 13 introduces and loads trays directly into cartons, which are then closed, sealed and discharged. There is no intervening bucket conveyor between the first tray conveyor and the carton conveyor 25, thus obtaining the advantages of cost, sound and part number reduction.

Figure 2:
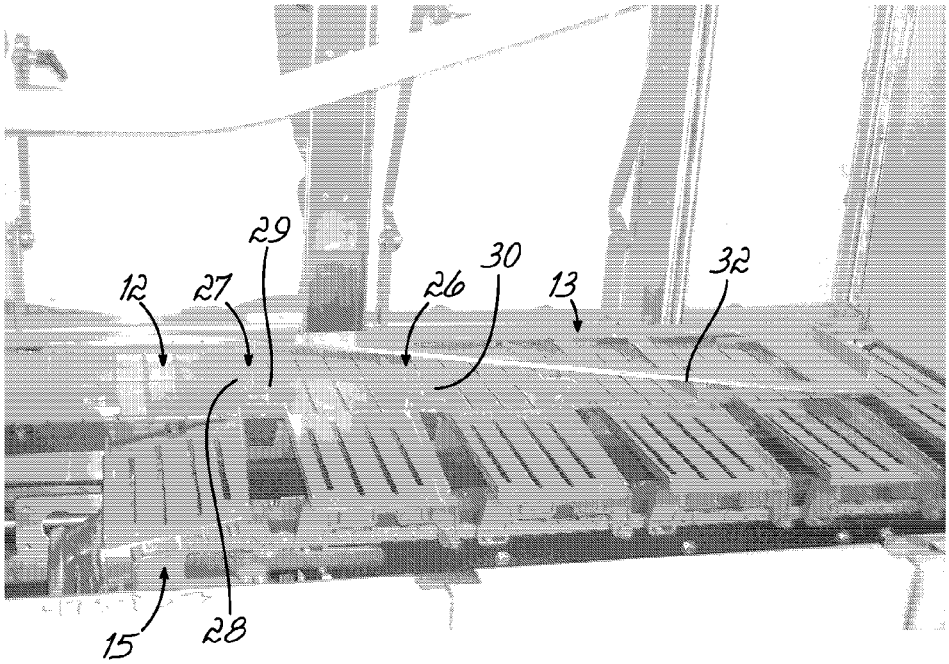
FIGS. 2-17 are black and white drawings base on photographic views of features of the embodiment of the invention of FIG. 1, all more particularly described as follows.

Turning to certain details of the turning and transfer aspects of the invention FIG. 2 illustrates details of the invention. The machine or first direction MD (FIG. 1) is from left to right in all FIGS. 1-34.

FIG. 2 illustrates the first tray conveyor 12, an adjacent bucket conveyor 15 and a hold-down guide 13. The conveyor 12 includes a plurality of identical lugs 26, 27 comprising sets of leading and trailing lugs, respectively, each set of lugs 26, 27 defining between them a space for receiving a flat tray. Each leading and trailing lug 26, 27 is preferably identical. Each lug has a rearward (with respect to direction MB) face 28 and a forward face 29. Face 29 also comprises a forward facing cam surface 30.

Turning guide 13 includes a guide surface 32 tapered from a position over a far edge of conveyor 12 to a position beyond a near edge of conveyor 12 over bucket conveyor 15 (in the embodiment of FIG. 1B, surface 32 extends to near the entry end of cartons to be filled).

Figure 2A:
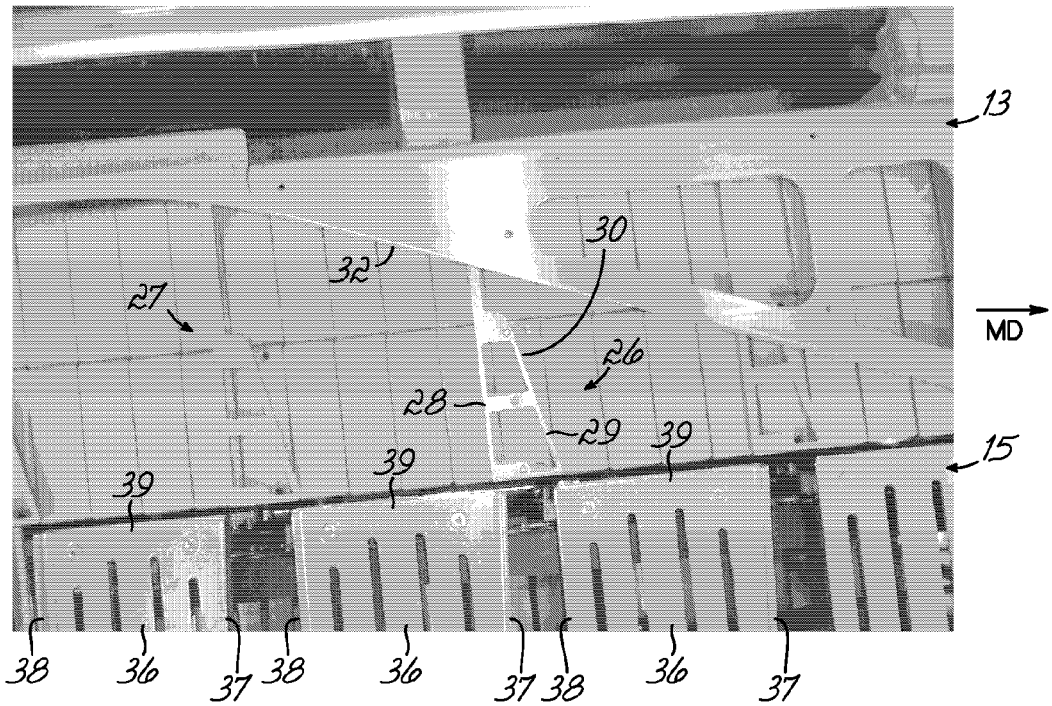
FIG. 2A is a plan view of a portion of FIG. 2.

These components are also similarly numbered in FIG. 2A, showing a plan view of the invention.

The remainder of the figures also illustrates various ones of these components.

Bucket conveyor 15 comprises a plurality of buckets 36, each having a leading wall 37 and a rearward wall 38. Preferably, the ends of walls 37, 38 nearest tray conveyor 12 define a bucket entry side or mouth 39. Leading wall 37 is preferably inclined rearwardly toward rearward wall 38 so the entry mouth 39 is of greater dimension than the distance between the walls 37, 38 at the side of the buckets furthest from tray conveyor 12.

Figure 3:
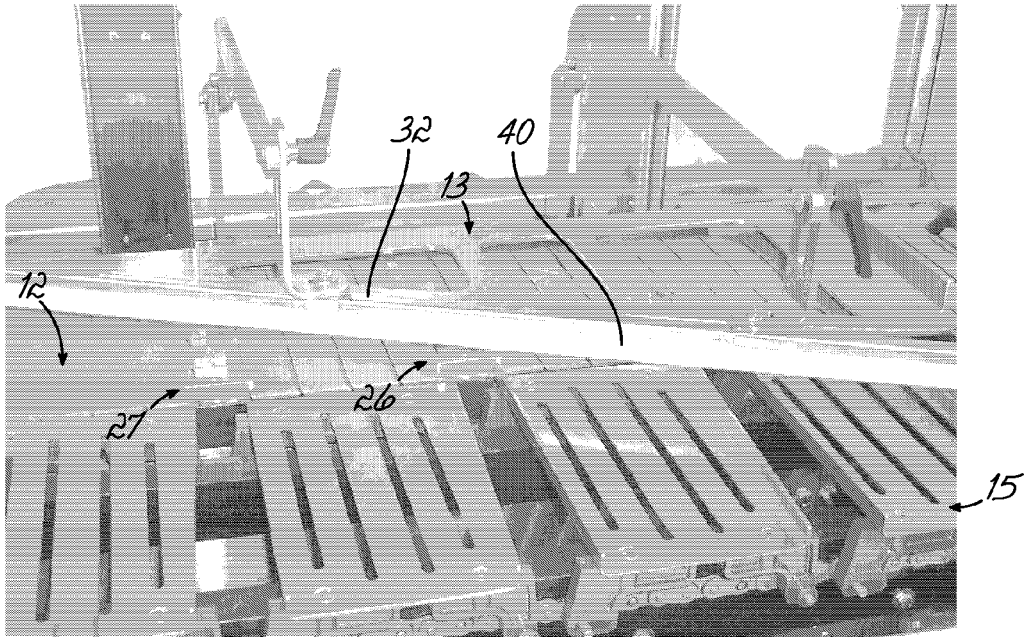
Figure 4:
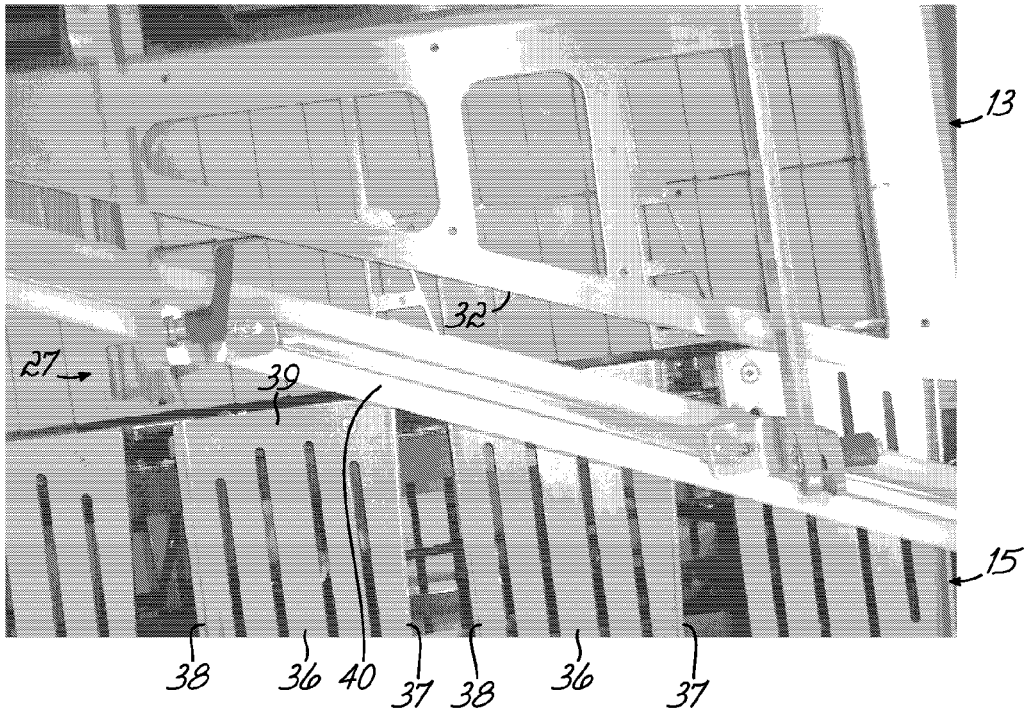
Figure 5:
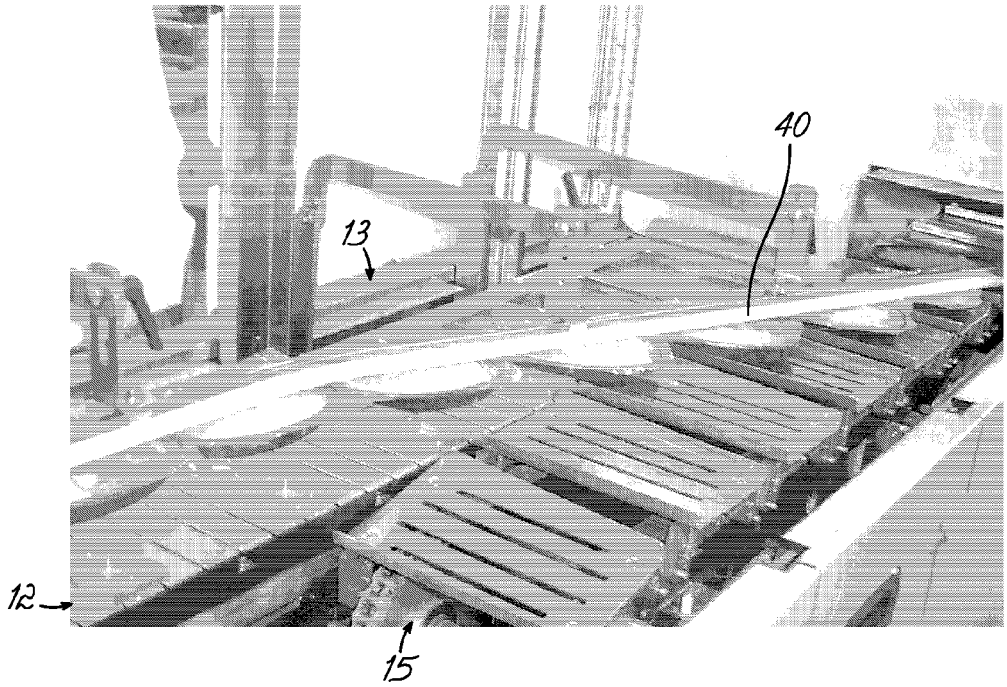
Figure 6:
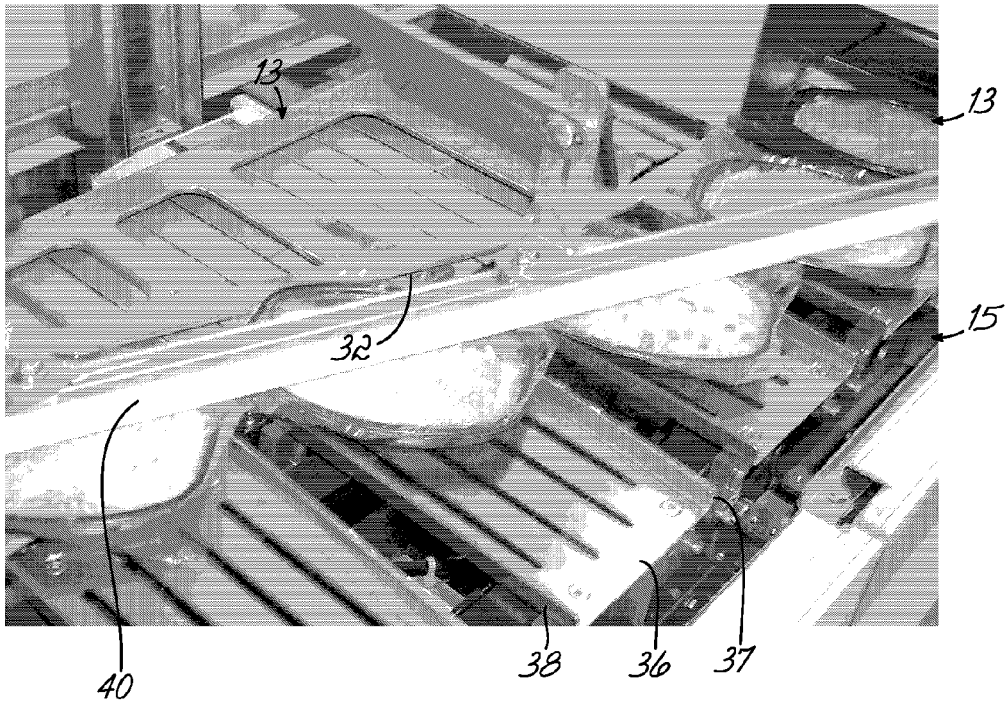
Figure 7:
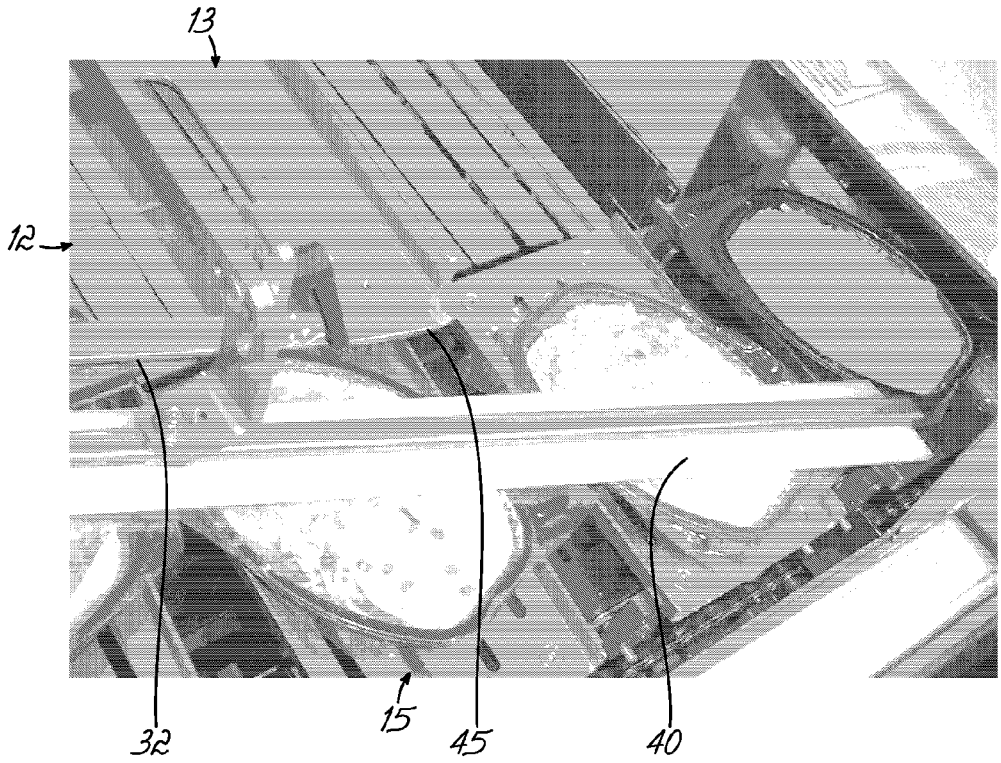

With reference to FIG. 3, the invention further preferably includes an optional, elongated hold-down guide 40 oriented operatively over the path traversed by trays T as they are conveyed by conveyor 12. The guide serves to keep the trays from climbing over the turning guide 13 and surface 32 thereof as the conveyor 12 urges the trays in the machine direction into contact with the guide B. Hold-down guide 40 is pivotally mounted for motion between the operative position shown in FIG. 3 and the inoperative position shown in FIG. 2.

This hold-down 40 is particularly useful where the trays have sides tapered upwardly and outwardly from tray bottoms. Turning guide surface 32 preferably engages the tray sides or upper rims, lids or film sealing the trays.

Figure 8:
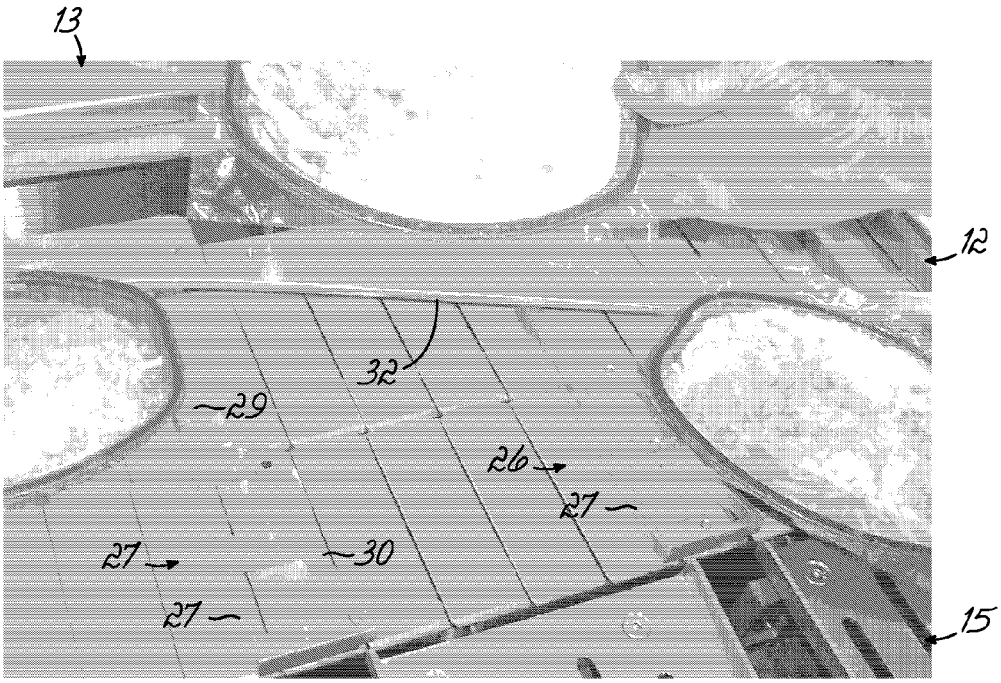
Figure 9:
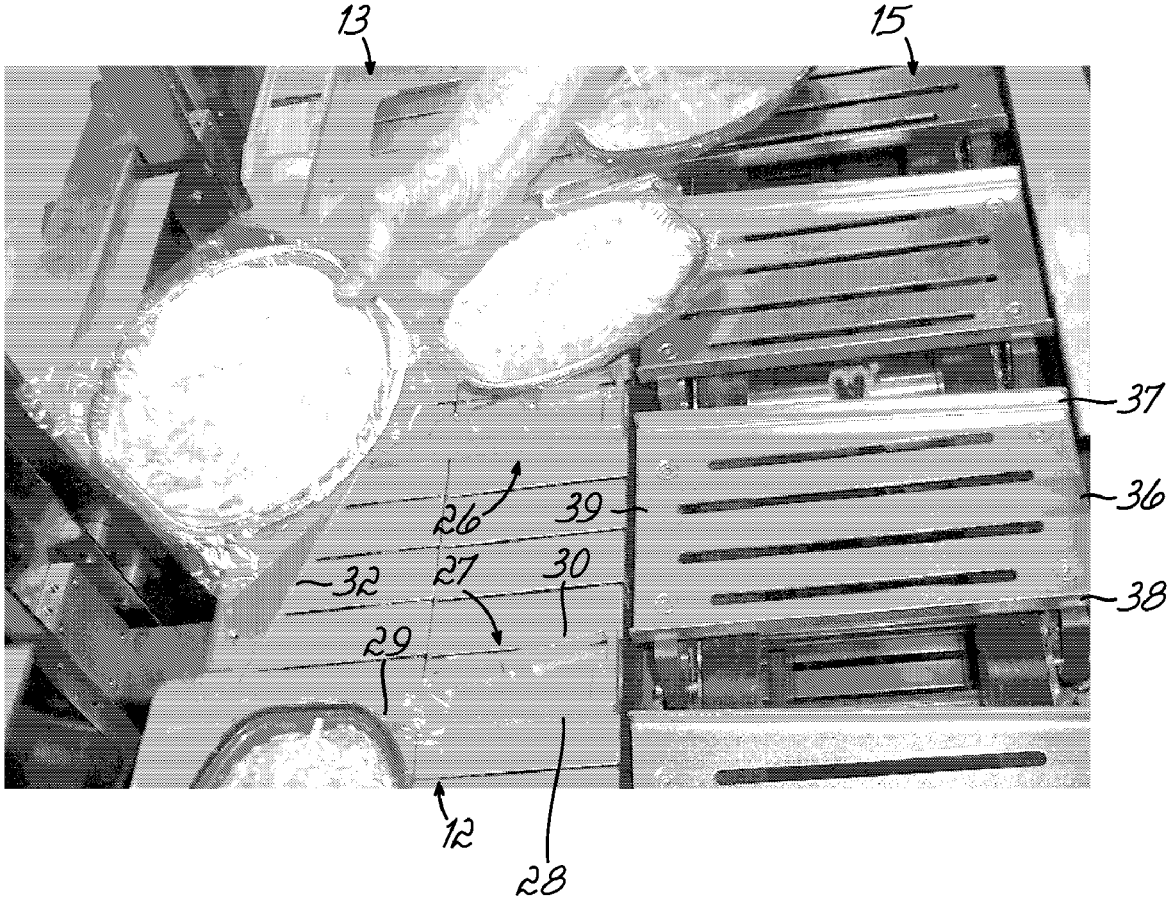

FIGS. 5-7 and 10-17 illustrate the progression of trays (in this case trays of frozen food covered or sealed with a clear plastic film) through the tray feed, transport, turn and transfer areas of the invention. FIGS. 8 and 9 show the relative size of one type of trays on conveyor 12, with one tray lifted out of succession for illustration clarity.

The tray feeding and indexing apparatus and operation is perhaps most clearly shown in FIGS. 14-17.

In this embodiment, opposed star wheels 11*a* and 11*b*, rotating on vertical axes, are disposed at the downstream ends of a "prime" or plurality of trays T transported on a low pressure infeed conveyor (FIG. 1). The stars respectively have radially extending coordinated tips defining cooperating opposed pockets therebetween as shown, to receive a single tray therebetween. When the cooperating tips of the respective stars approach each other, they select one leading tray and hold back all following trays. The angular velocity of the stars, which may be servo or mechanically or hydraulically driven, is predetermined or selected to match the pitch between the trays to the space defined by the sequential lugs 26, 27 (FIG. 14) on the tray conveyor 12. As the stars rotate, their cooperating tips move away from each other, releasing the momentarily captured, and now indexed tray to the space between the lugs 26, 27 on conveyor 12.

It will also be appreciated that the width of the tapered bucket mouth can be selected as required, and that the shape of surface 32 and cam 30 can also be selected to facilitate turning and loading particular size and shape trays. The cam surfaces 32 and 30 can be changed out to accommodate a variety of trays or products to be cartoned.

Moreover, it will be appreciated that the trays are subjected only to a gentle pivoting action while also gently transferred in the second direction into the buckets of conveyor 15 (or the cartons on conveyor 25, FIG. 1B). The remaining FIGS. 11-13 further illustrate the continuous and sequential turning and loading of trays as shown and through the end position 45 (FIG. 12) of turning guide surface 32.

FIGS. 18-34 are more diagrammatic illustrations of the apparatus and methods of the invention.

Figure 18:
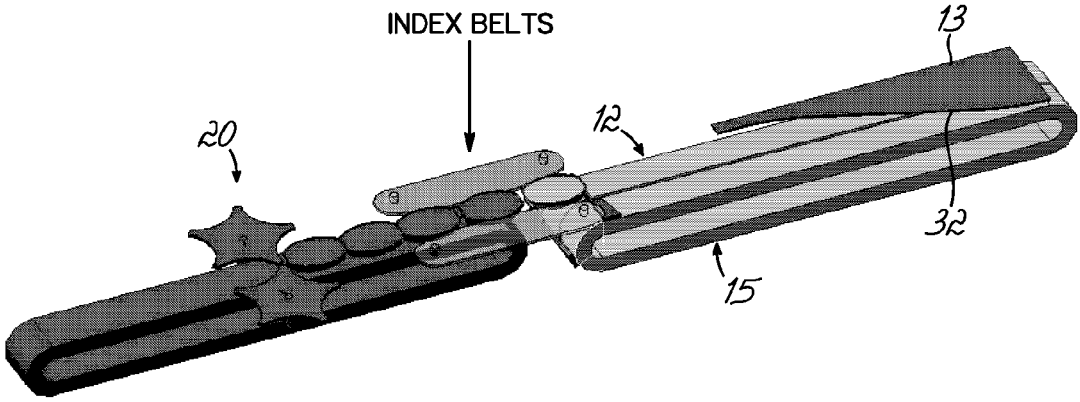
FIG. 18 is a diagrammatic perspective illustration of an alternate embodiment of the invention showing the pressure relief star-wheel prime control and opposed indexing belts as in FIG. 1A.
Figure 19:
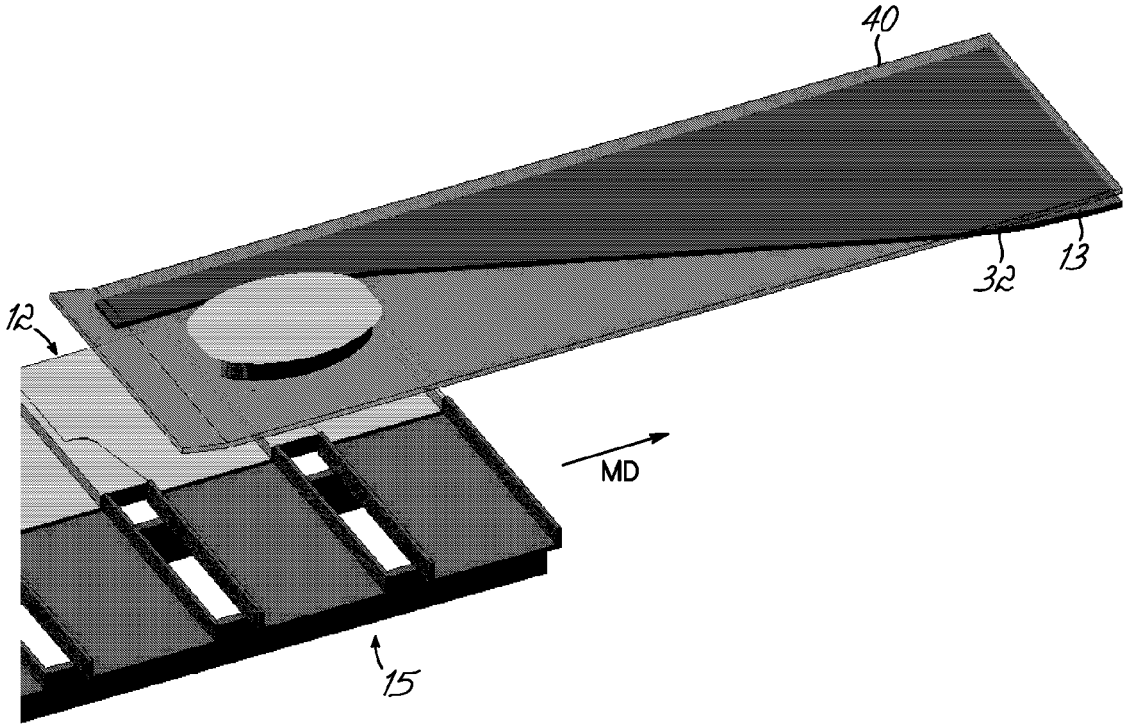
FIGS. 19-21 are diagrammatic perspective views showing the turning of trays and their loading into buckets according to the invention and as more particularly described below.

FIG. 18 is a more perspective diagram of the embodiment shown in FIG. 1A.

Figure 10:
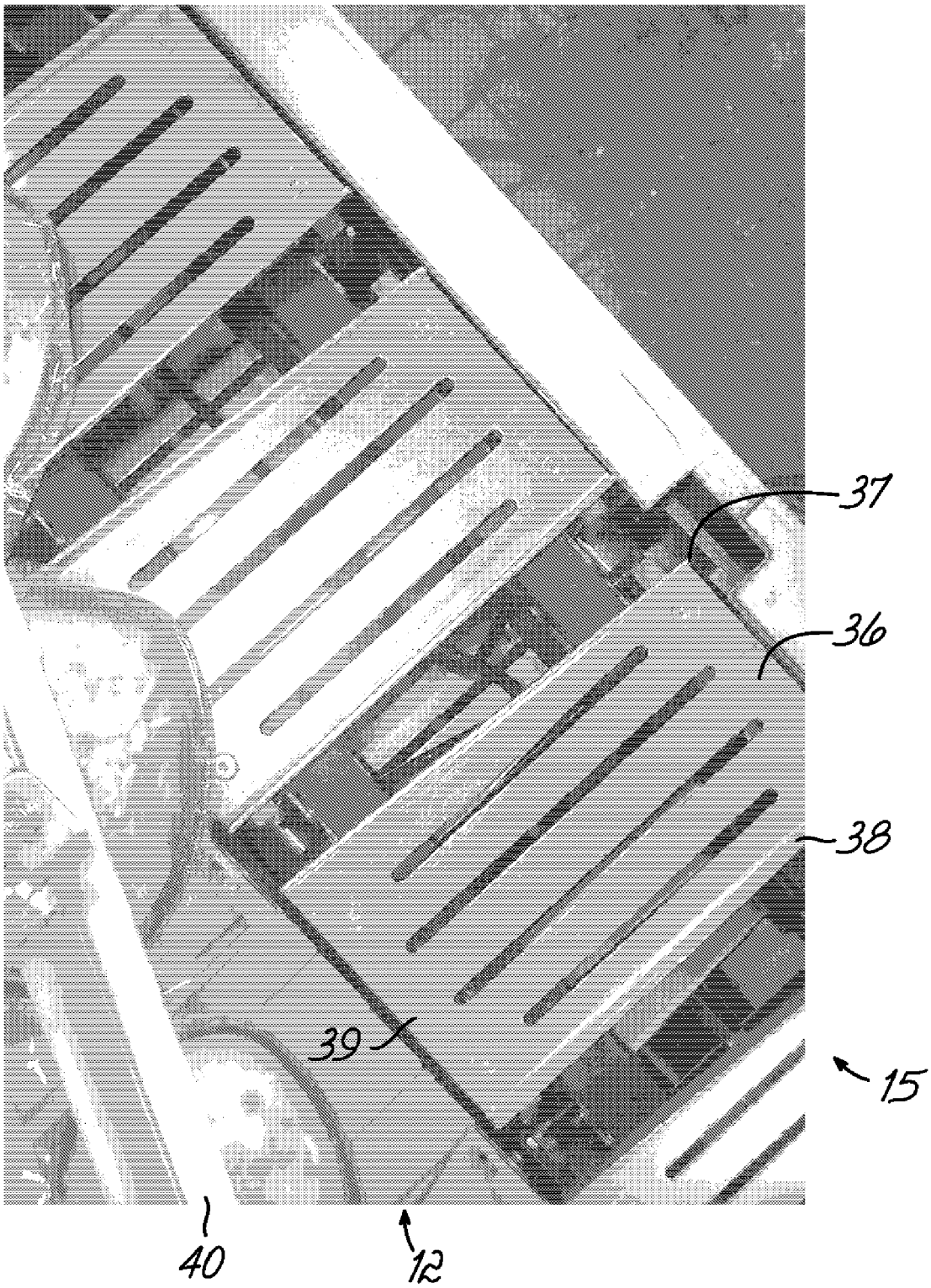
Figure 11:
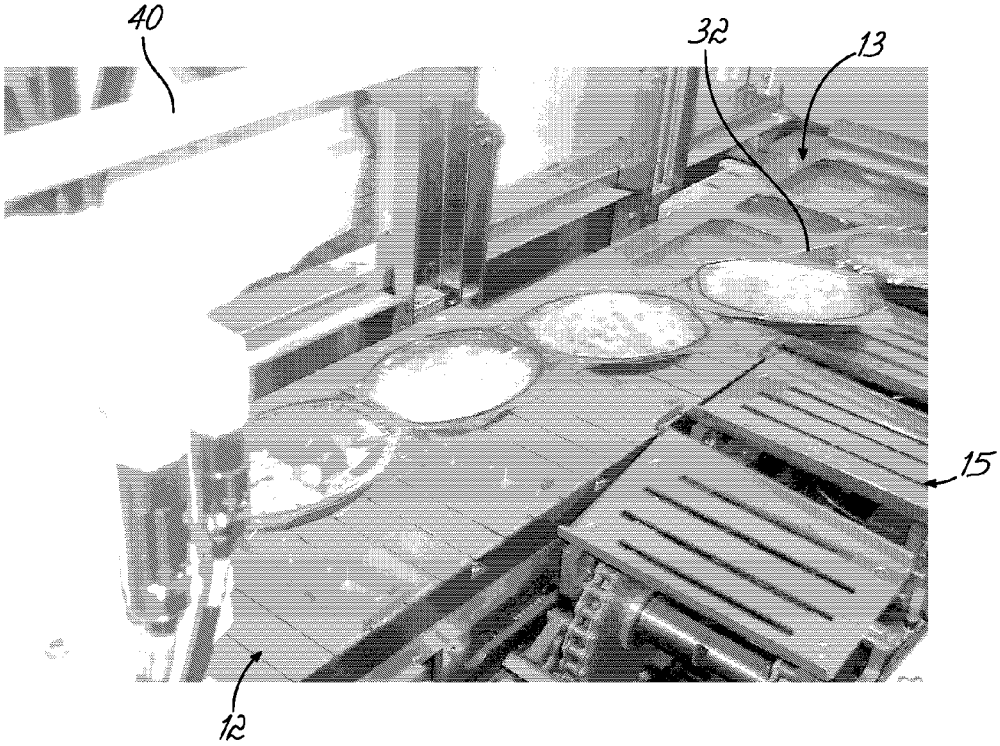
Figure 12:
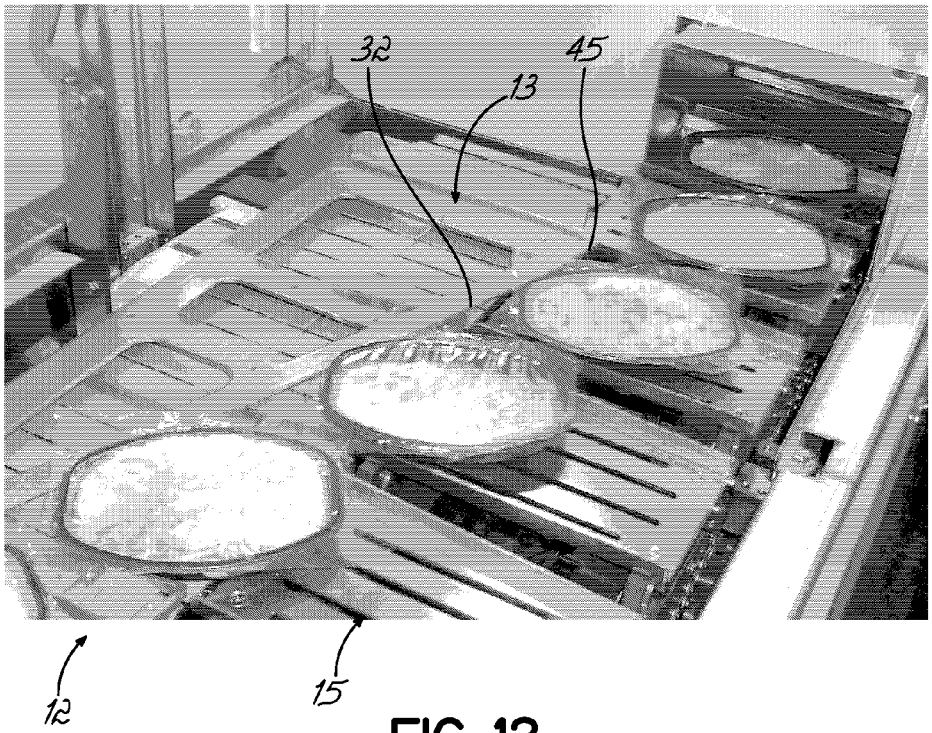
Figure 13:
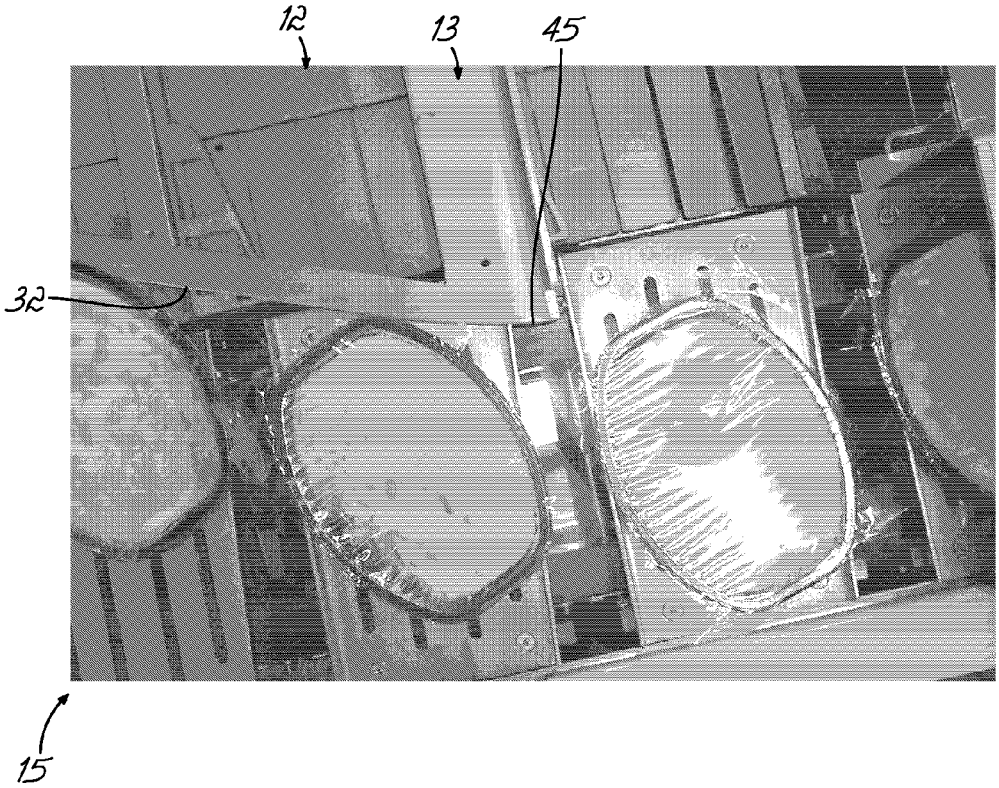
Figure 14:
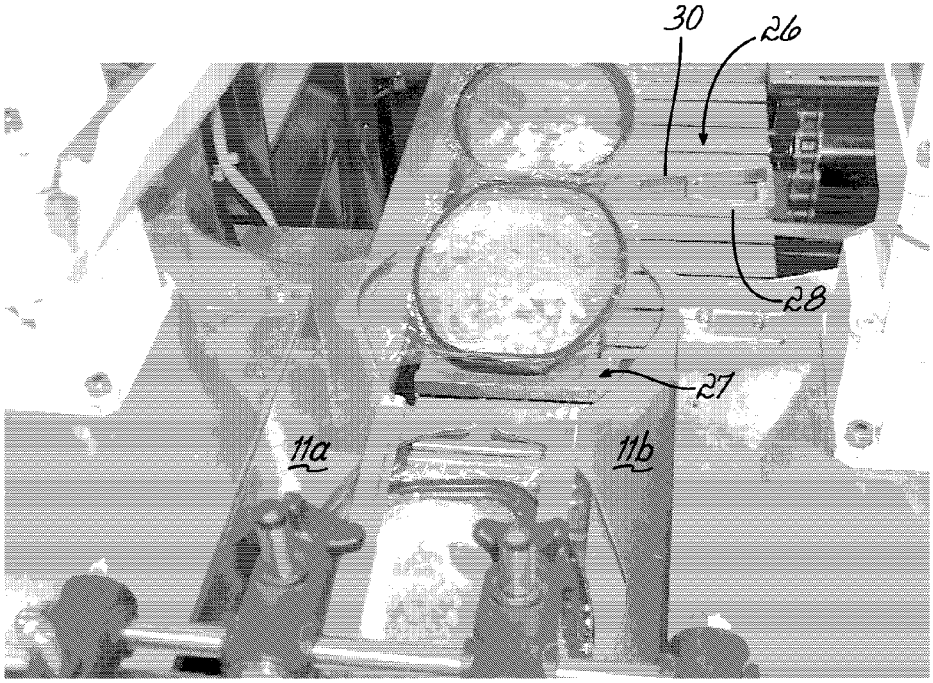
Figure 15:
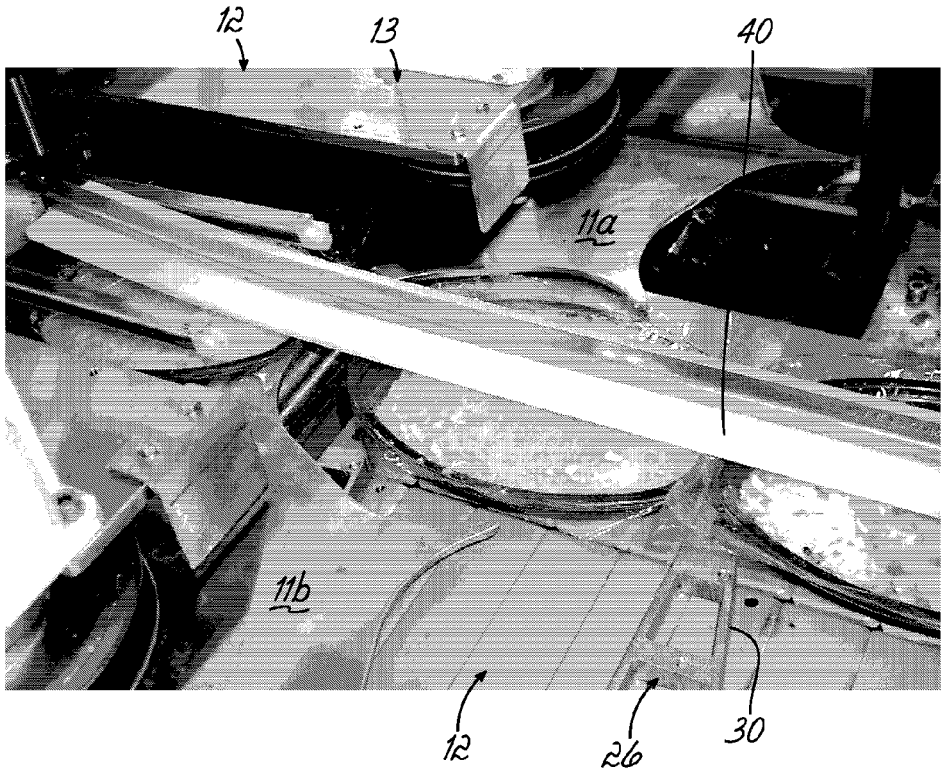
Figure 16:
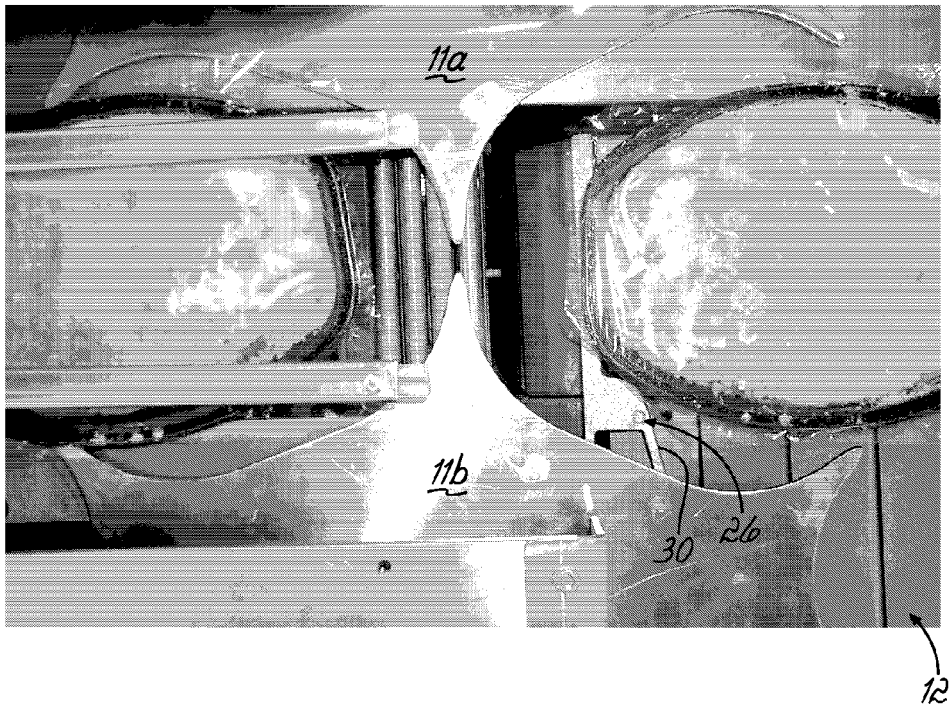
Figure 17:
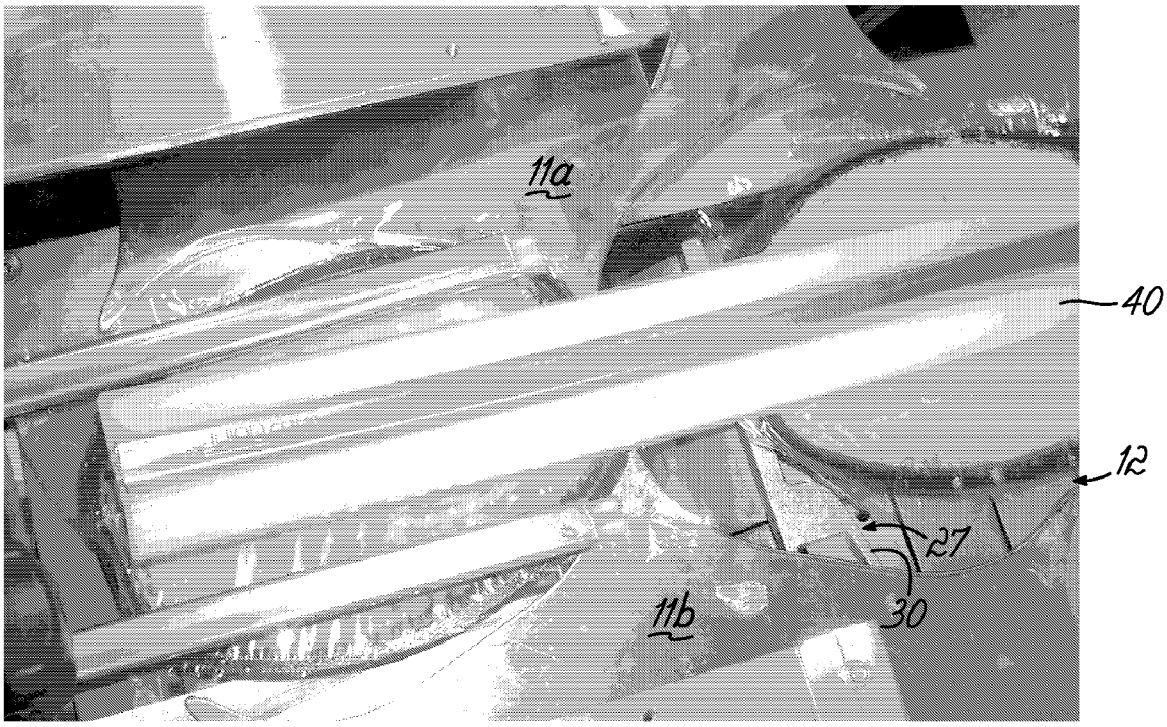

The dynamic geometry of the turning guide surface 32 on the trays in combination with the cam surface 30 is shown in various figures, perhaps best in FIGS. 8 and 9. The surface 32 engages the left front corner of the narrow end of the elongated tray. The forward end of the tray is thus urged by that surface 32 toward bucket conveyor 15. The tray is also being driven by a trailing lug surface 29 on conveyor 12. The turning tray is also urged against cam surface 30 as the tray is progressively turned. Cam 30 thus provides a cam or pivot surface against or about which the tray is turned. As the tray is turned, it is also displaced transversely in a second direction perpendicular to the first or machine direction MD toward and into a bucket through mouth 39 (FIGS. 2A and 10).

It will be appreciated that the parameters of the guide surface 32 and of the cam 30 are selected to facilitate both turning of the trays and transverse insertion into the buckets, so that the leading narrow end of the trays is directed into the bucket mouth as illustrated.

Figure 20:
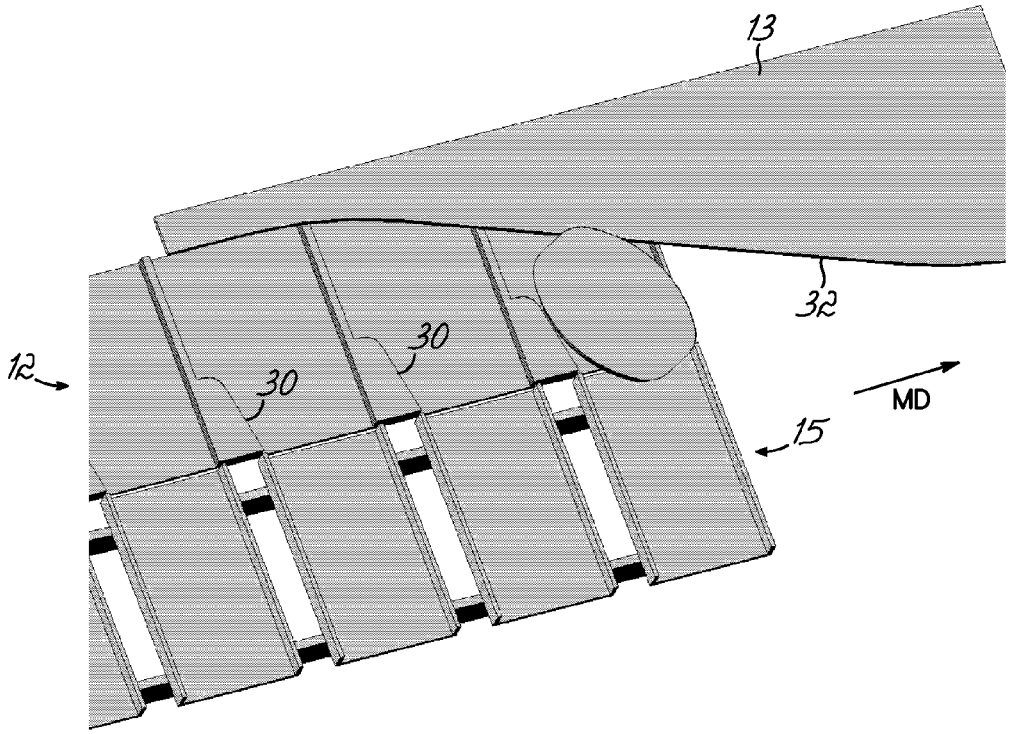
Figure 21:
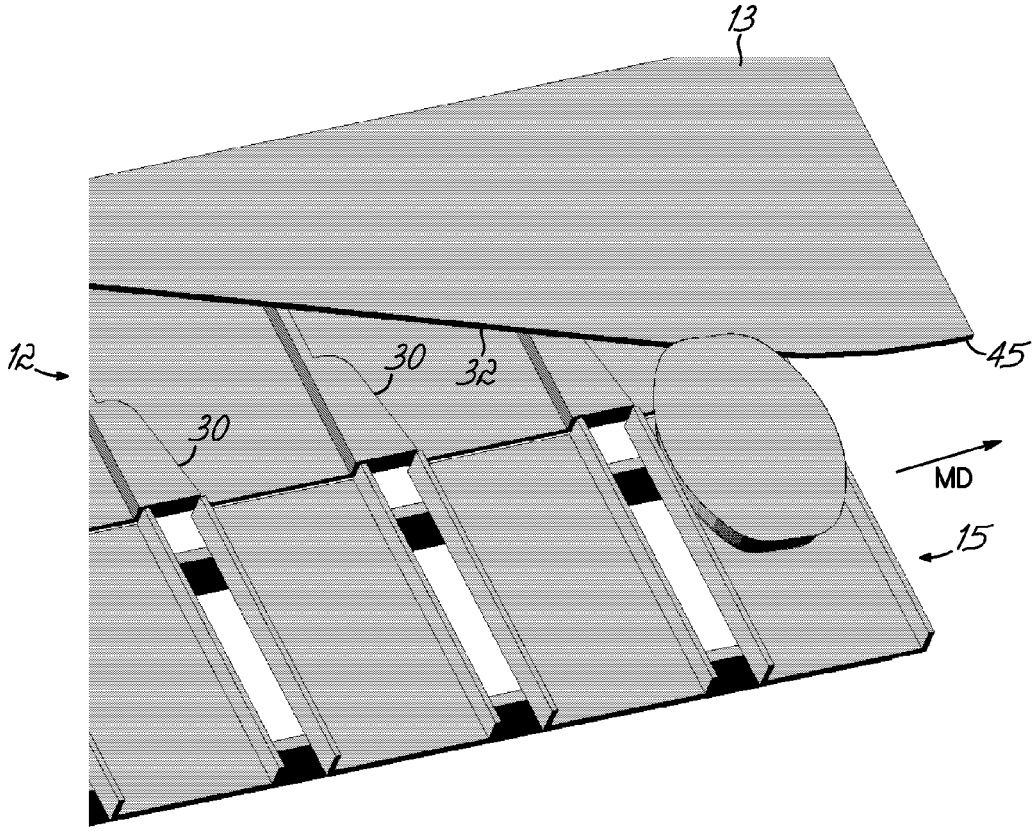
Figure 22:
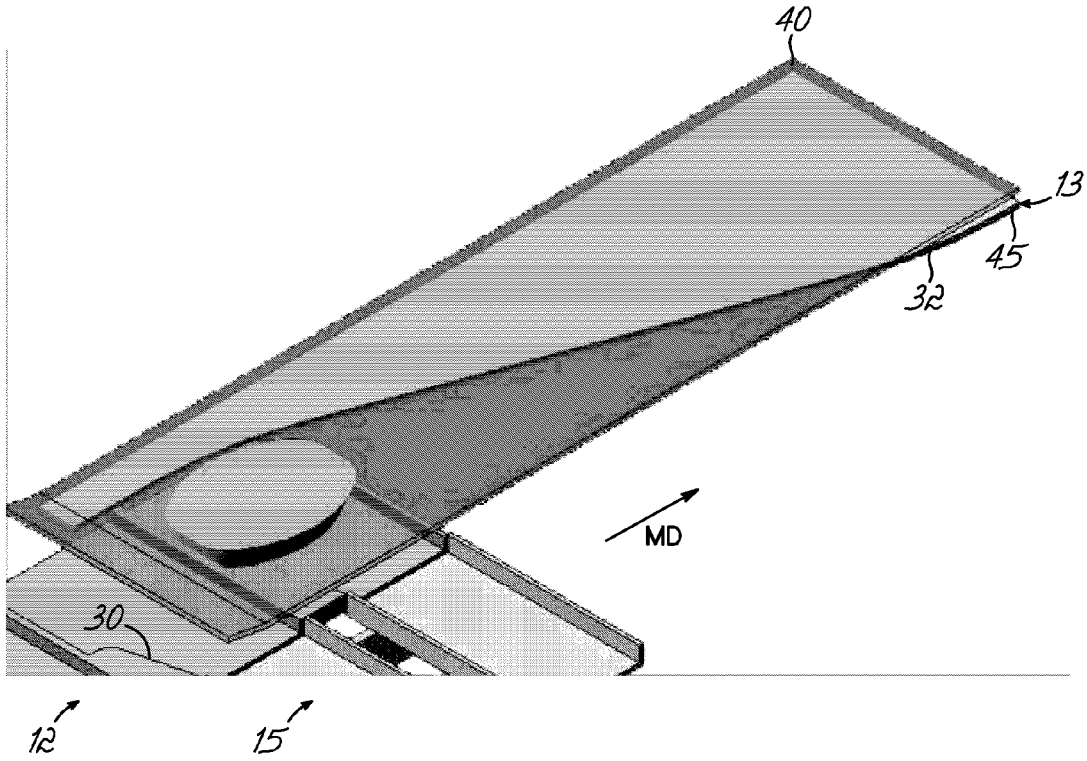
FIGS. 22-31 are diagrammatic illustrations showing the progressive turning and loading sequence of one tray as it moves, is turned by, and loaded into a bucket by the turn guide, with the hold-down graphically illustrated over the turning tray in the prime figures and with the hold-down guide removed and more detail shown in the figures with suffix A.
Figure 23:
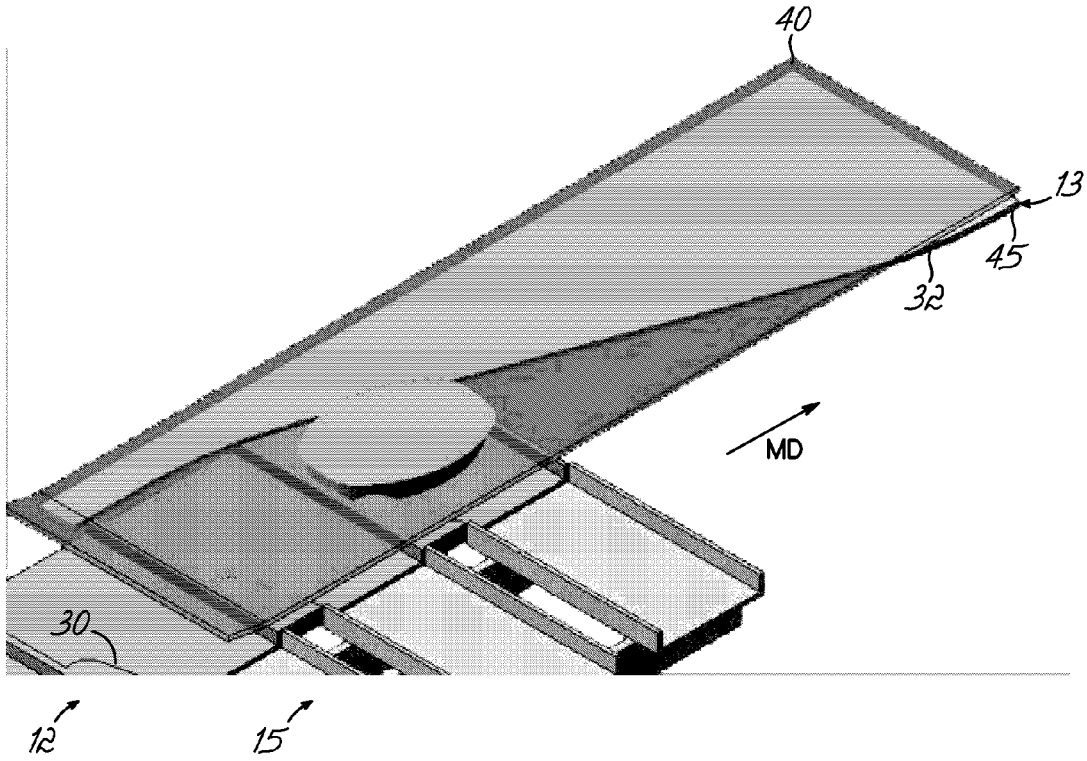
Figure 22A:
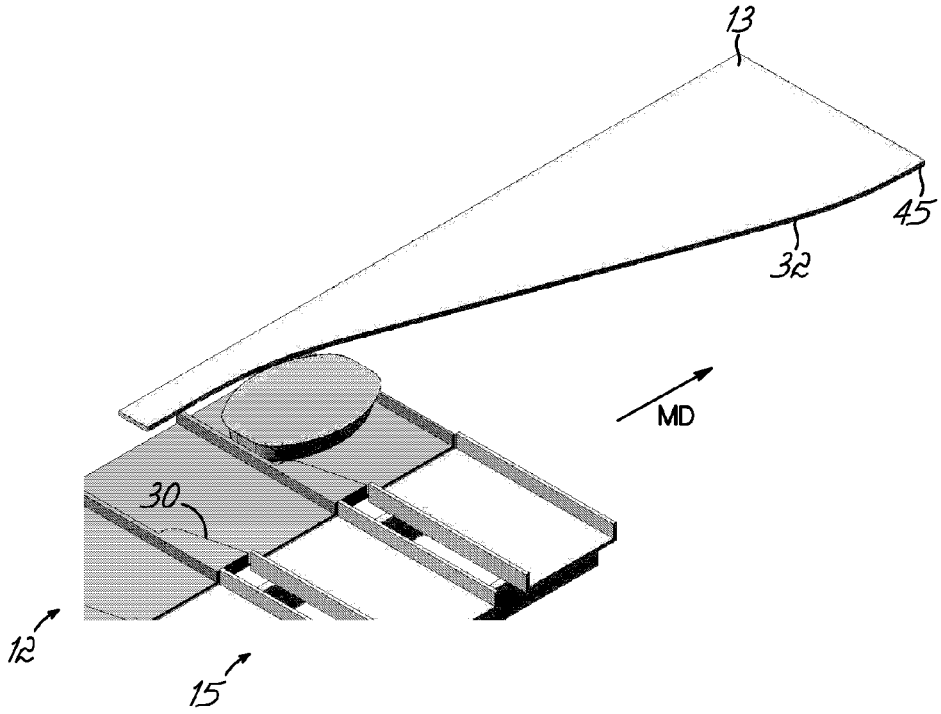
Figure 23A:
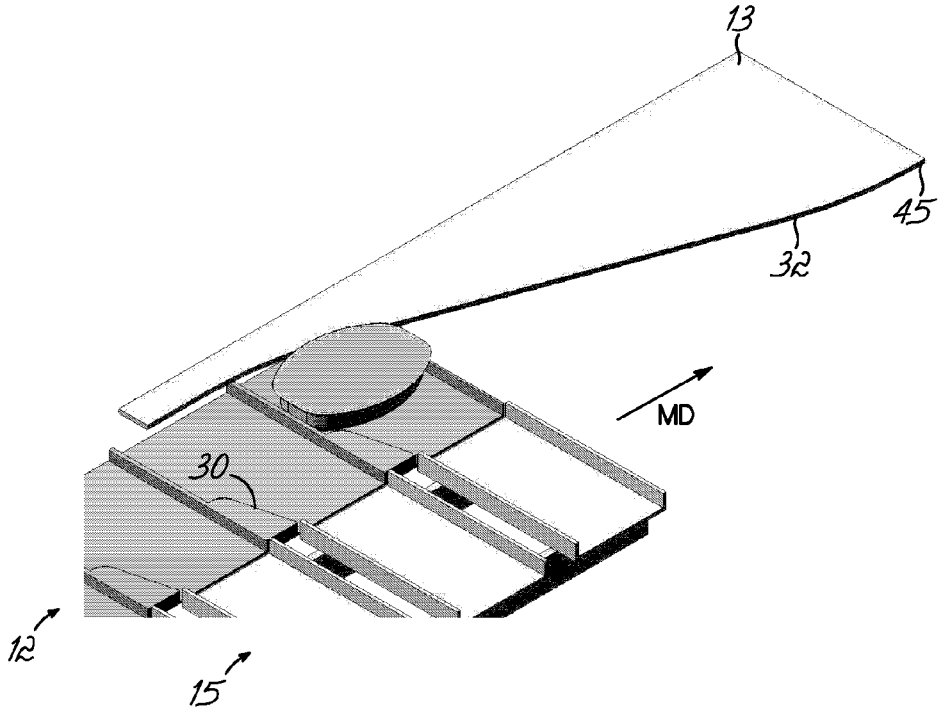
Figure 24:
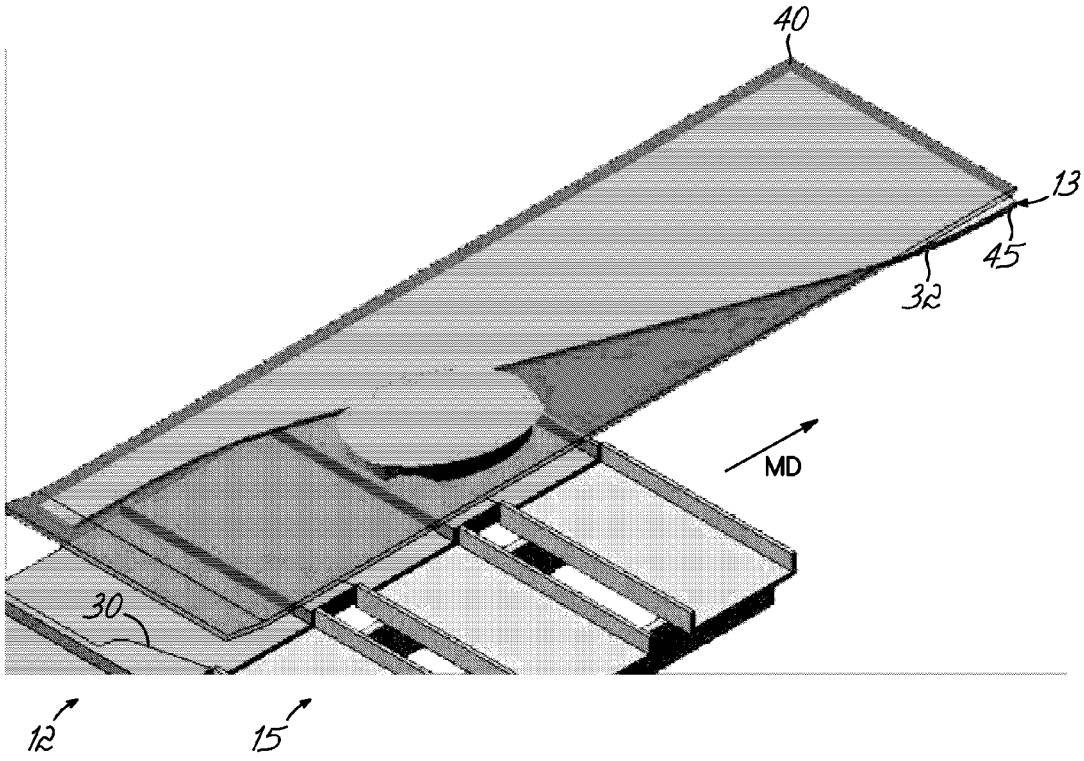
Figure 25:
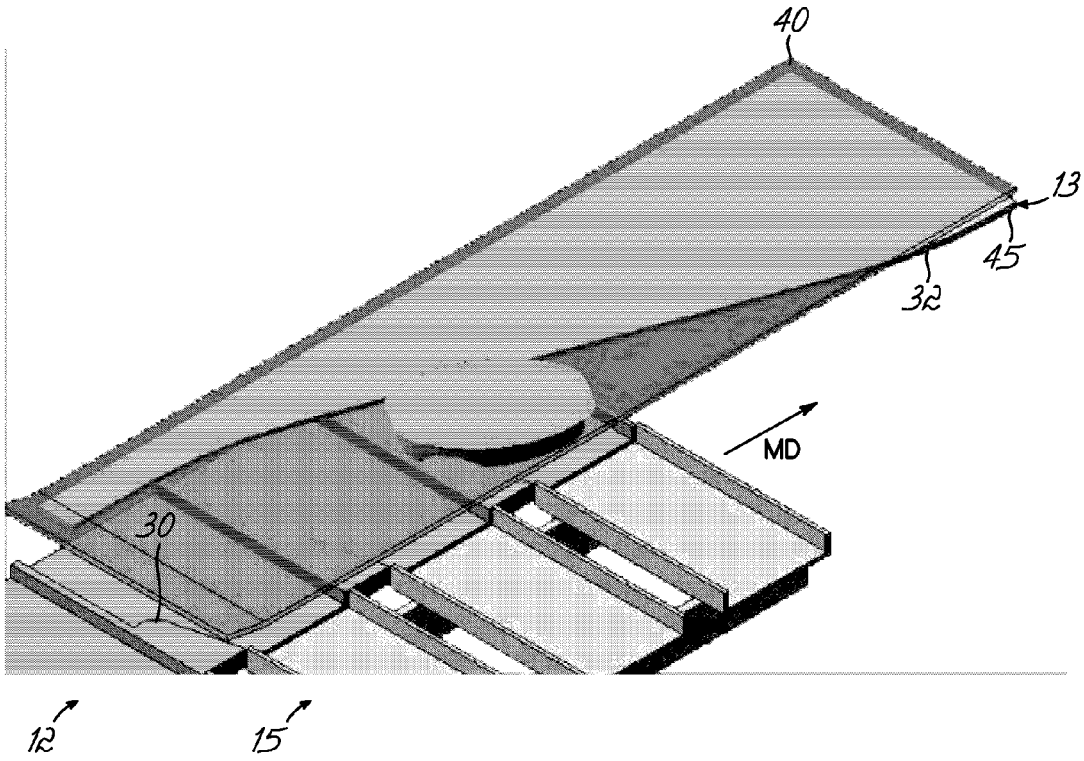
Figure 24A:
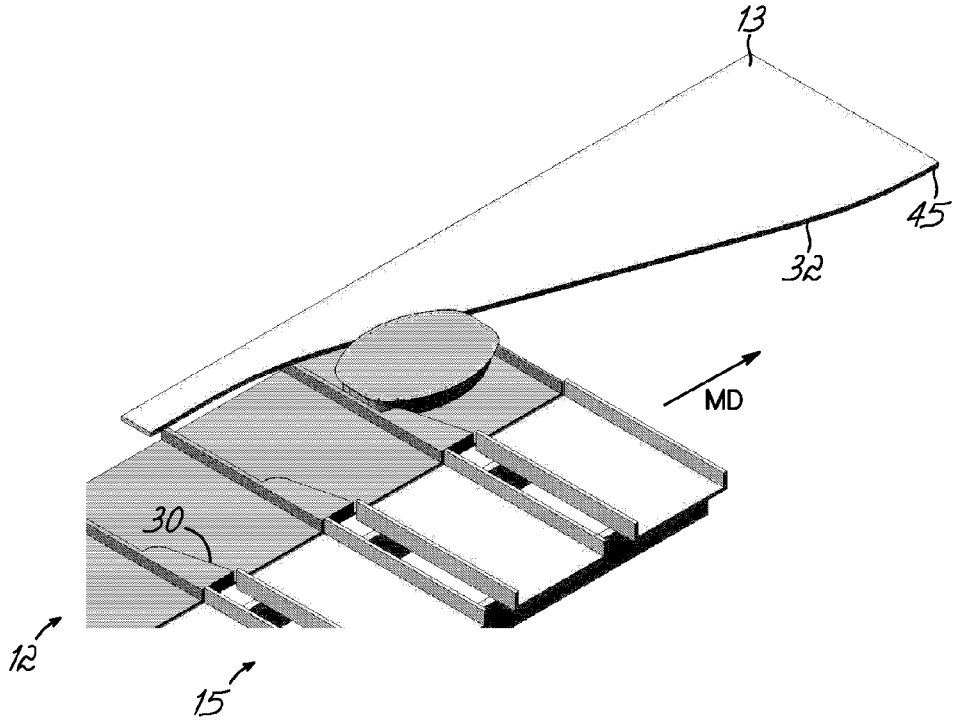
Figure 25A:
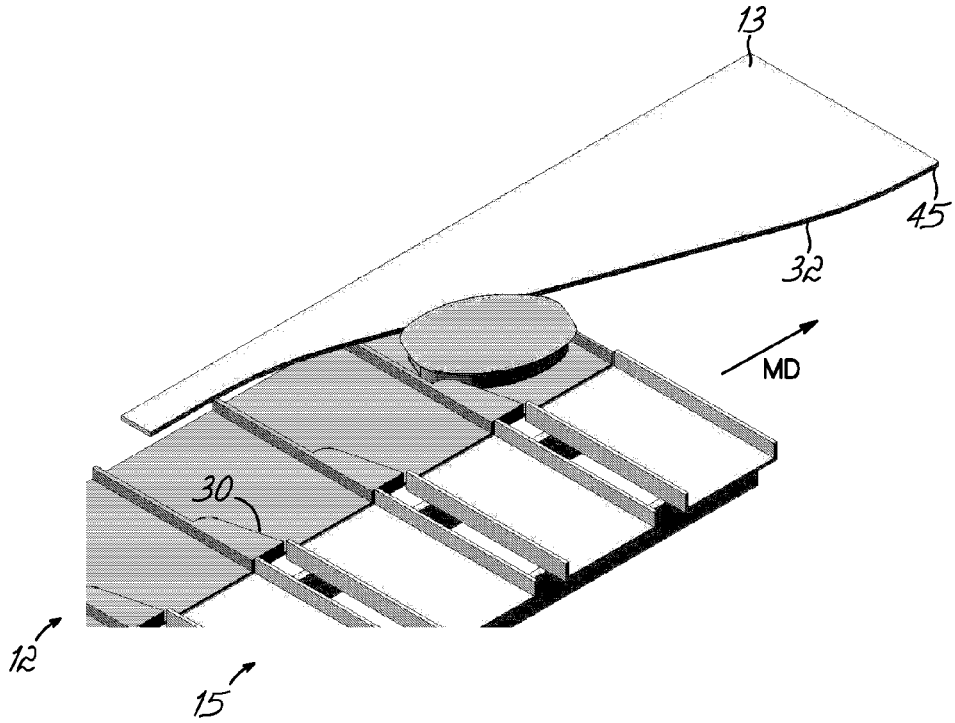
Figure 26:
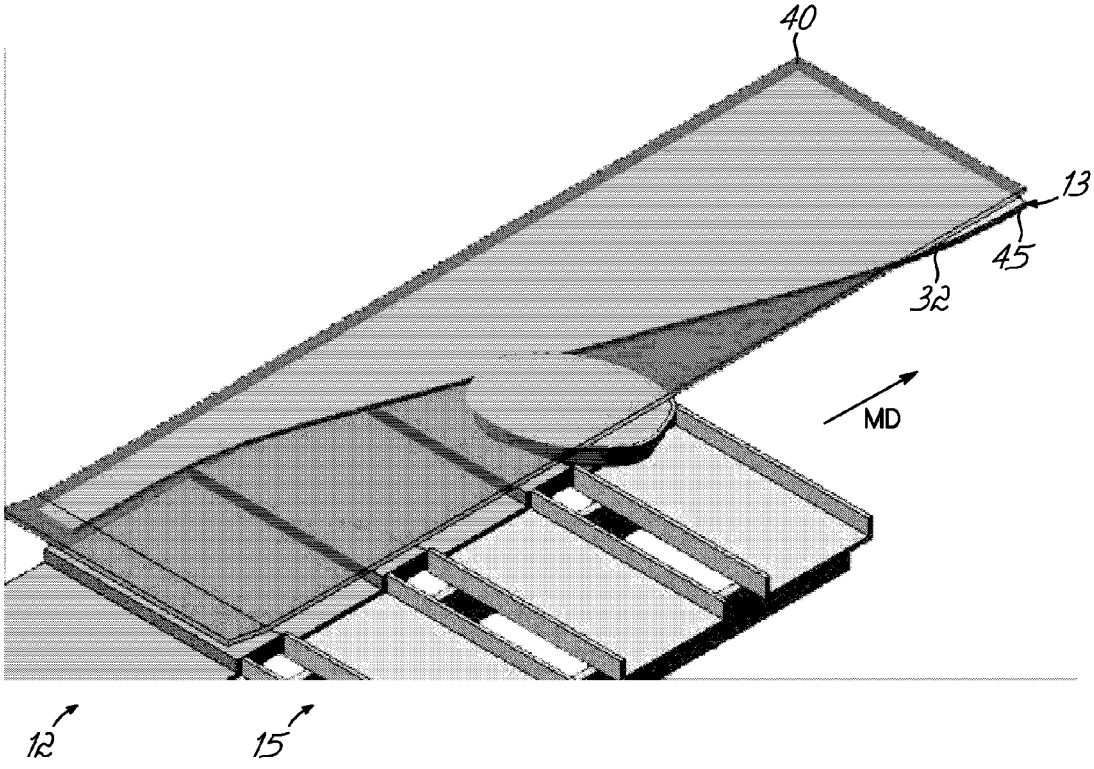
Figure 27:
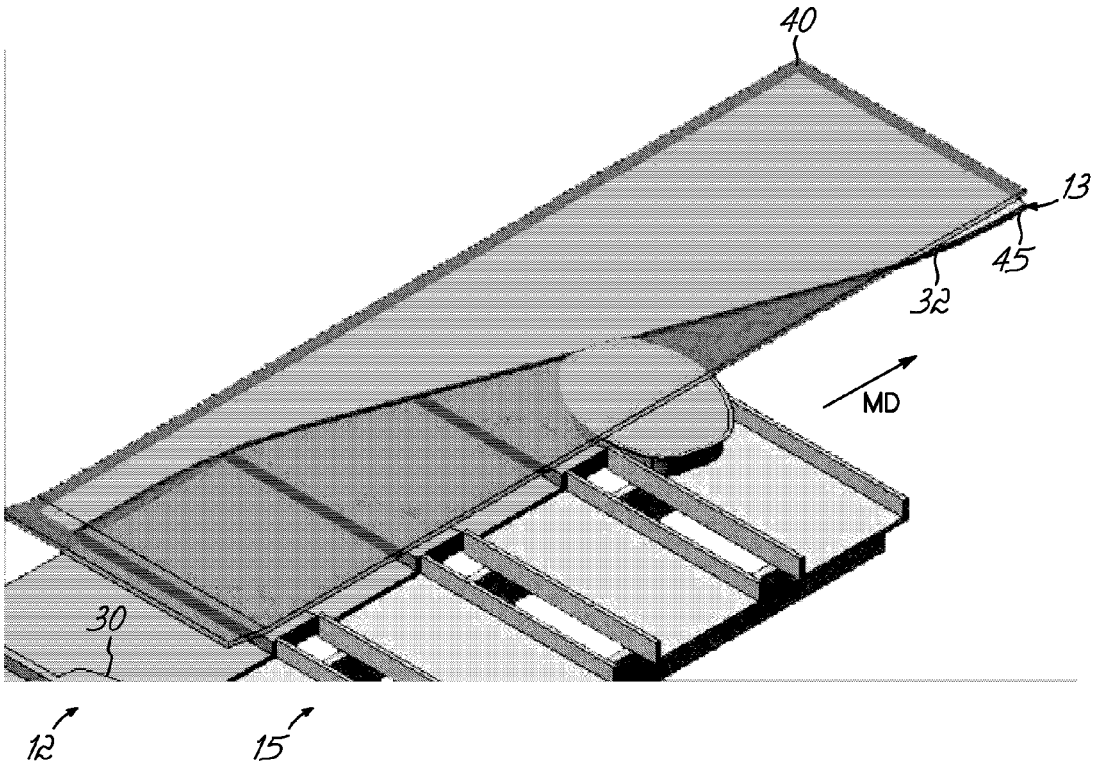
Figure 26A:
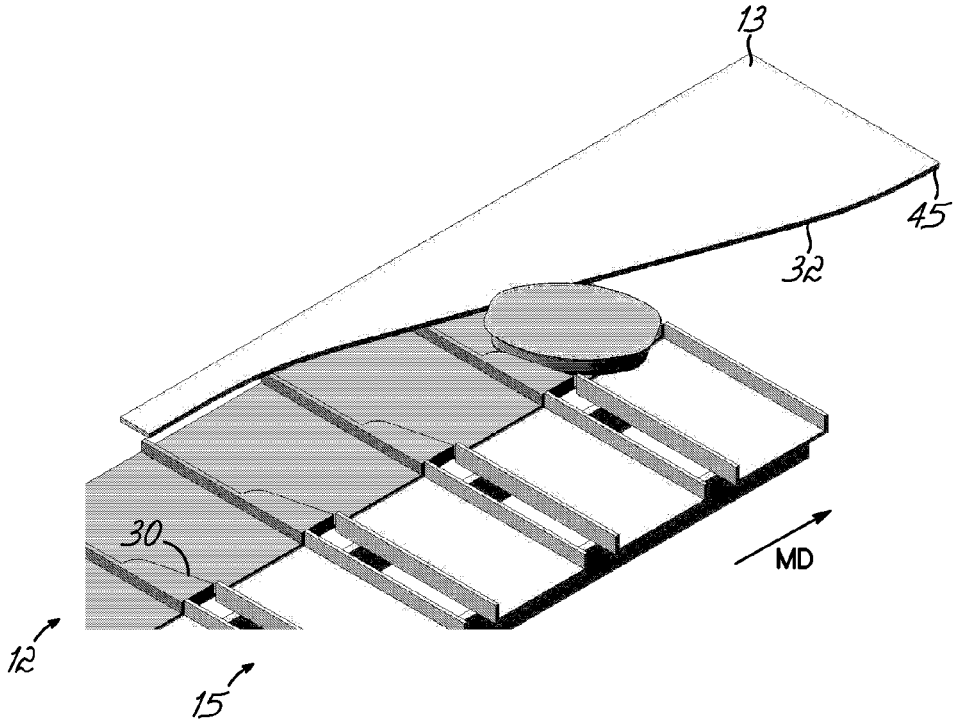
Figure 27A:
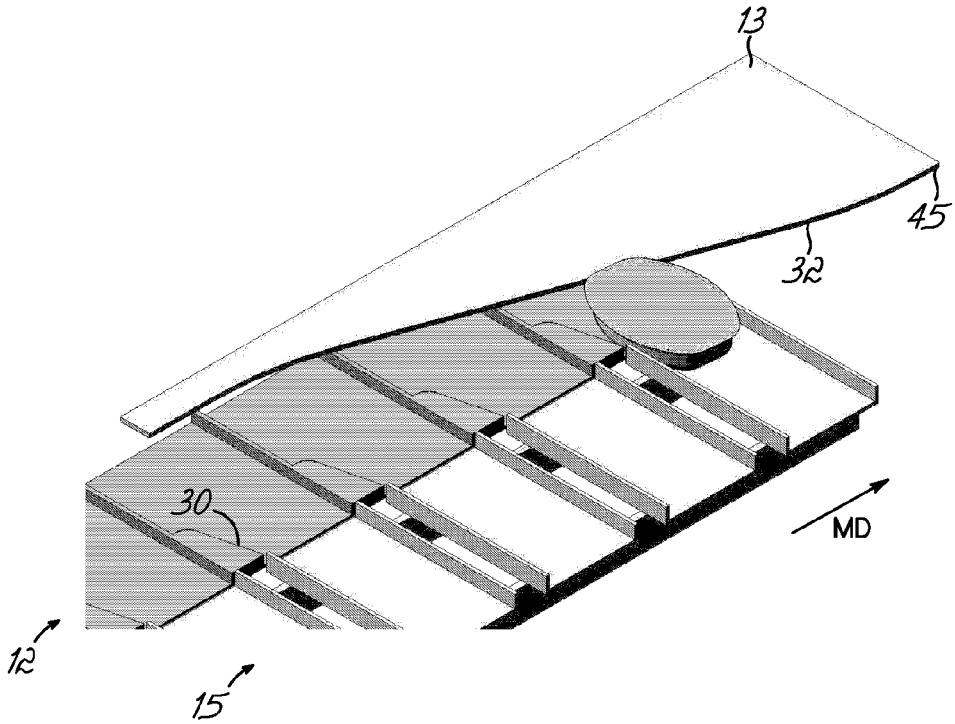
Figure 28:
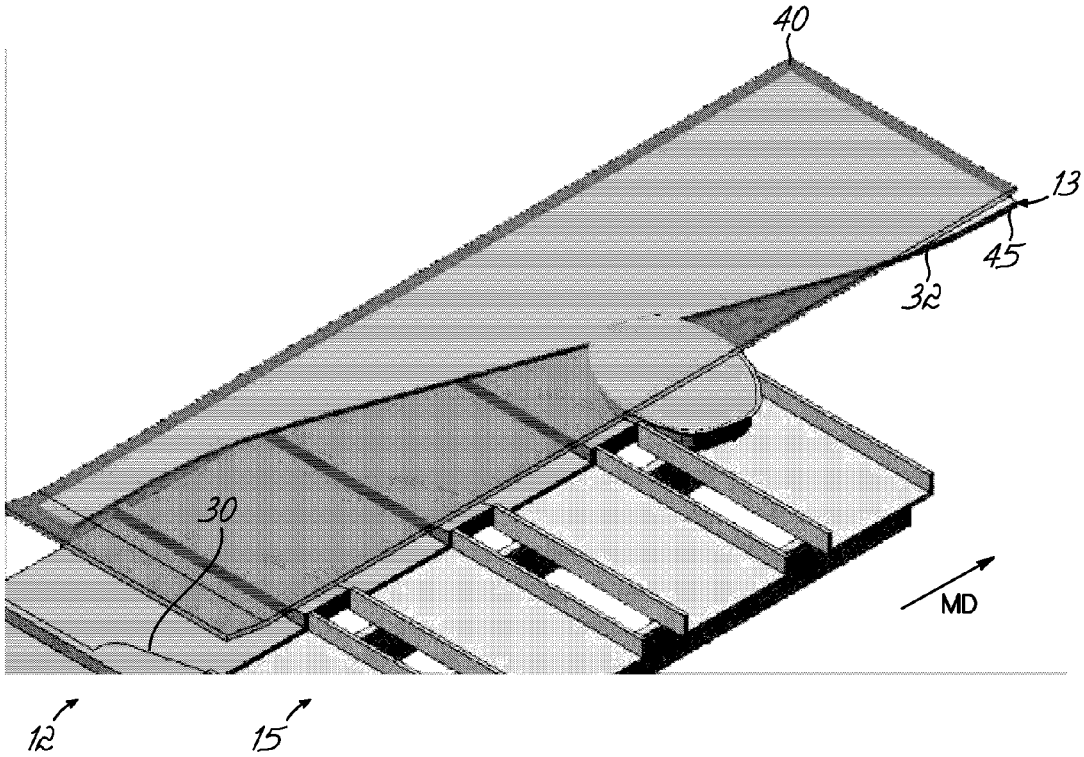
Figure 29:
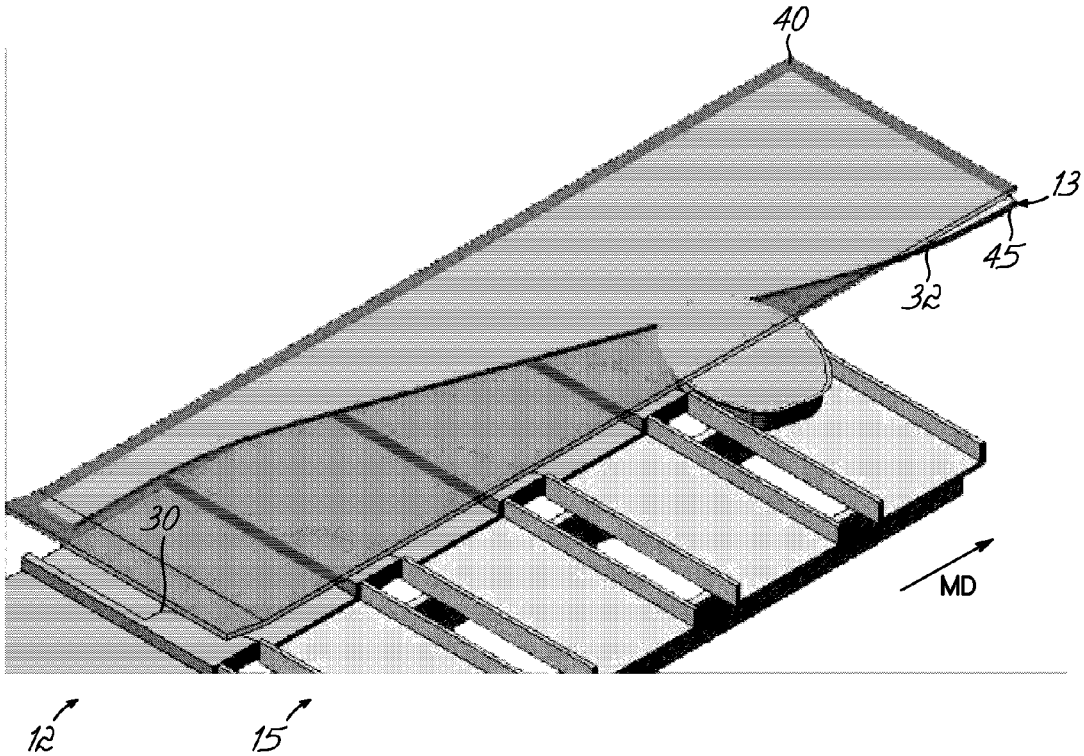
Figure 28A:
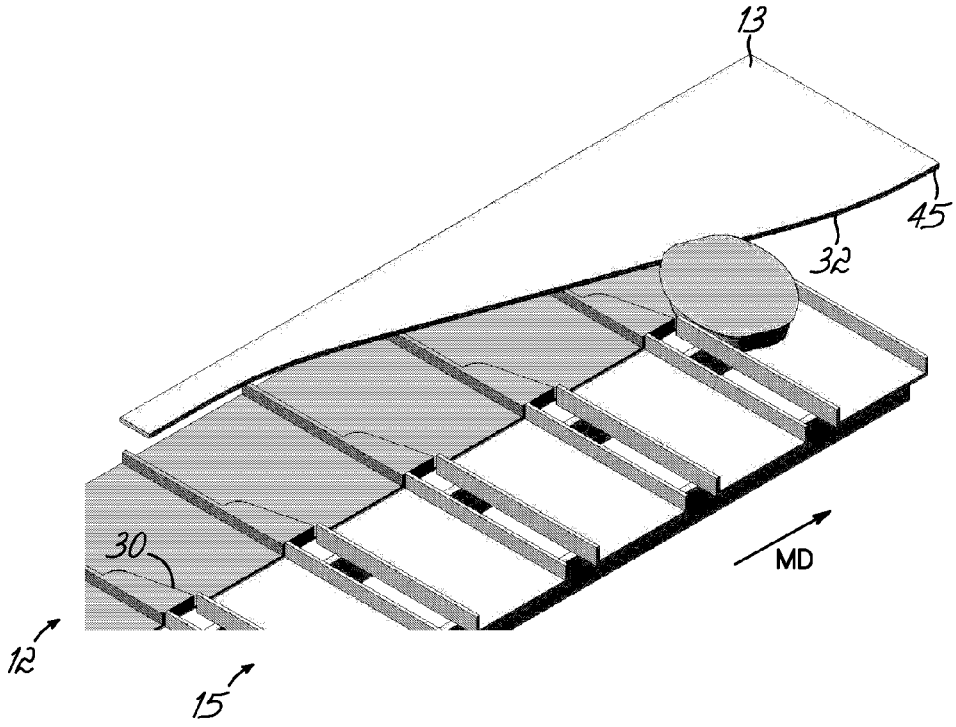
Figure 29A:
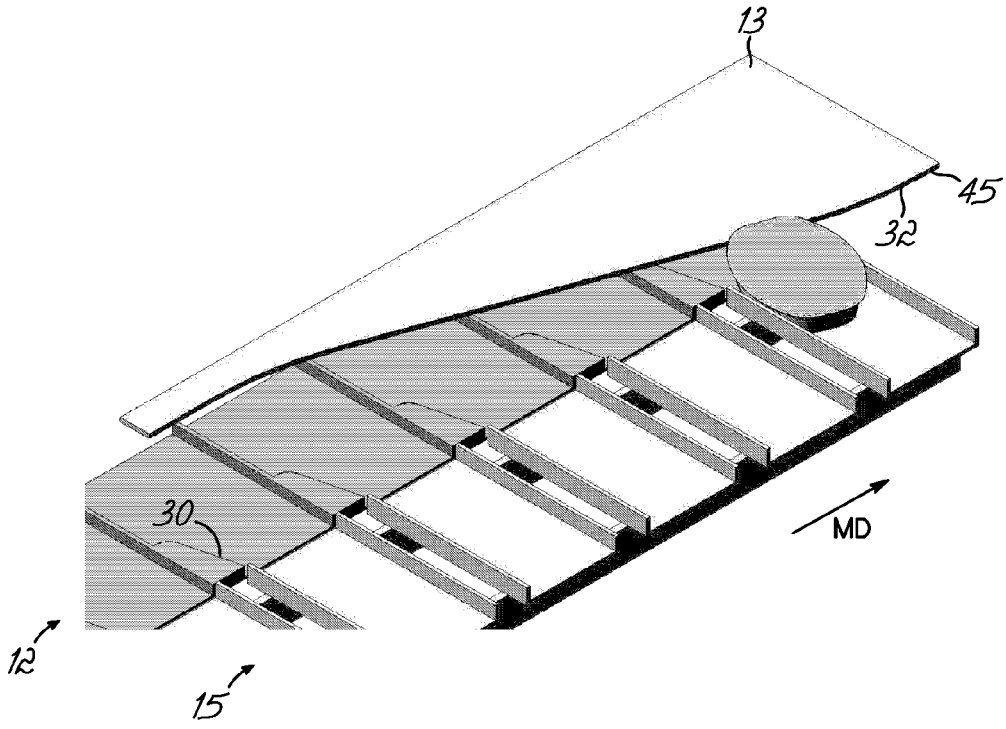
Figure 30:
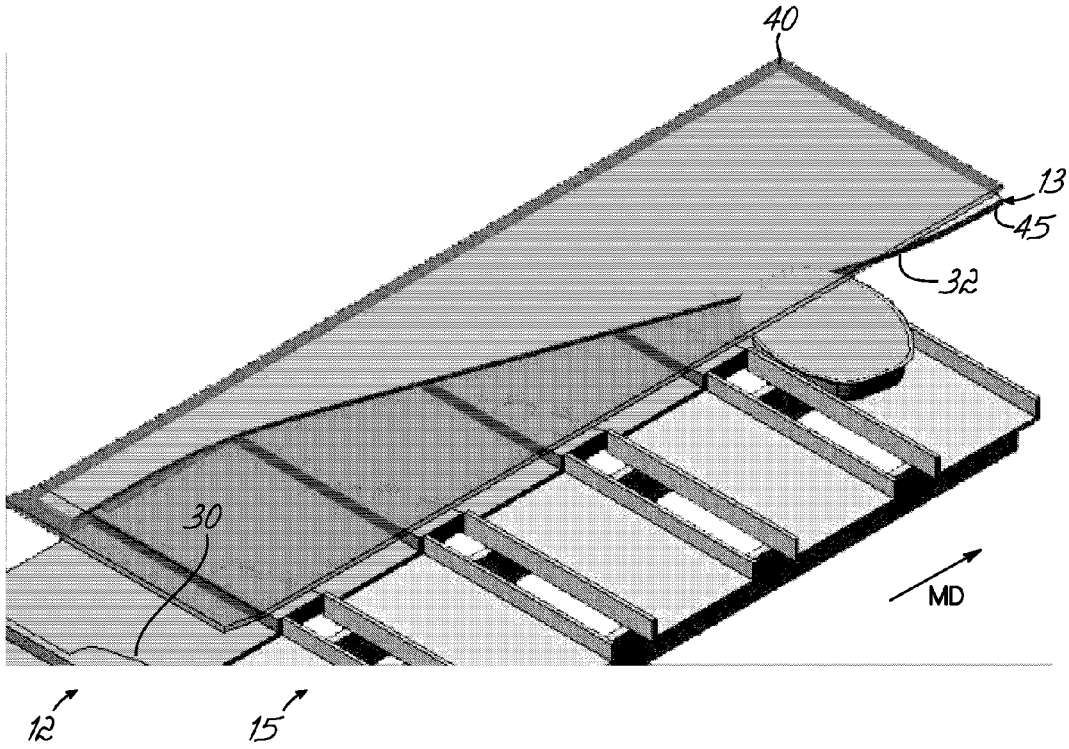
Figure 31:
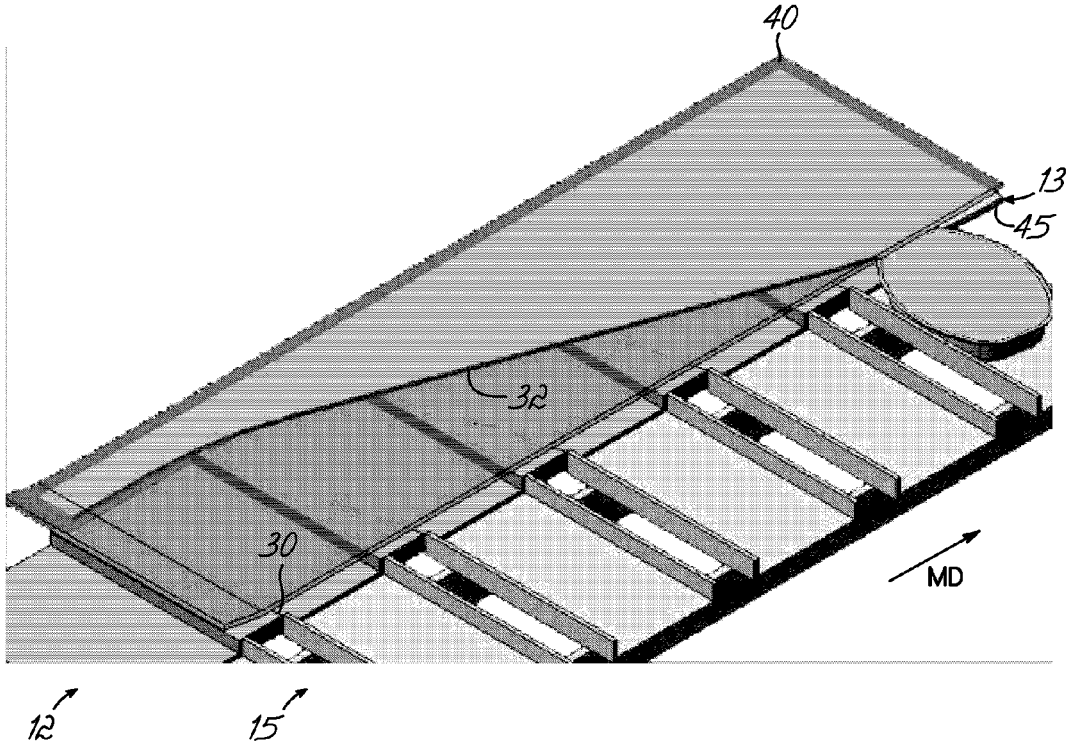
Figure 30A:
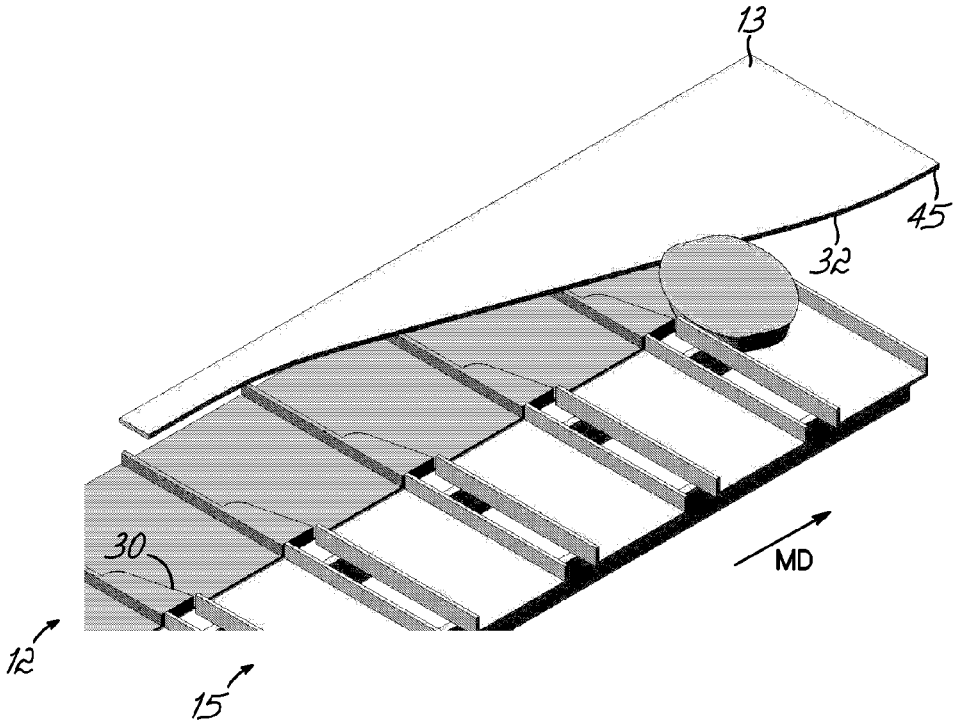
Figure 31A:
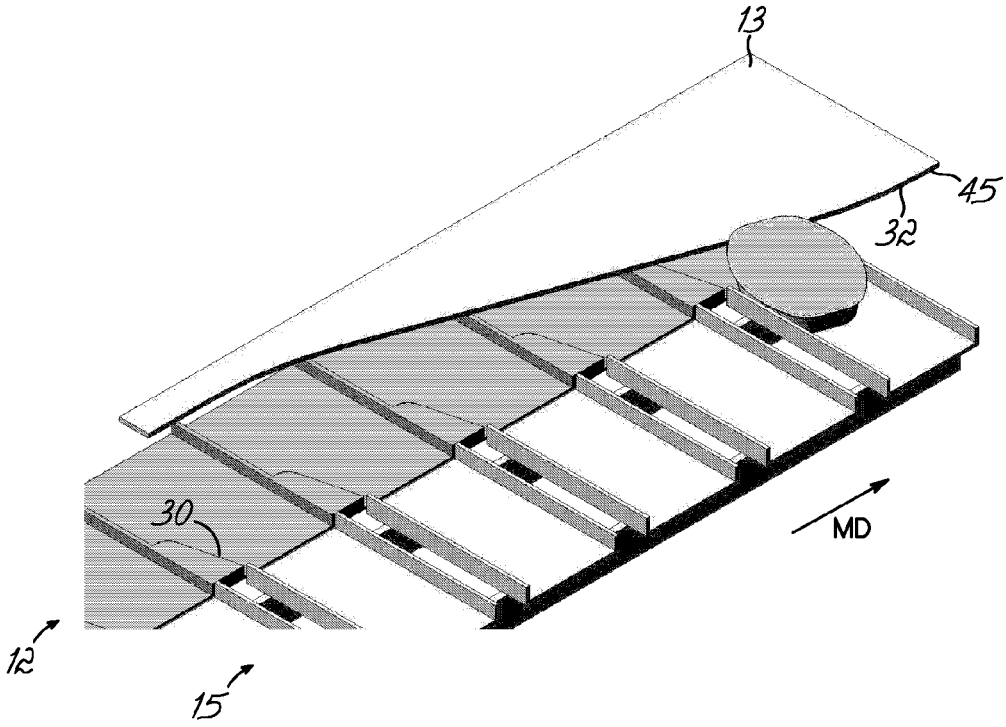
Figure 32:
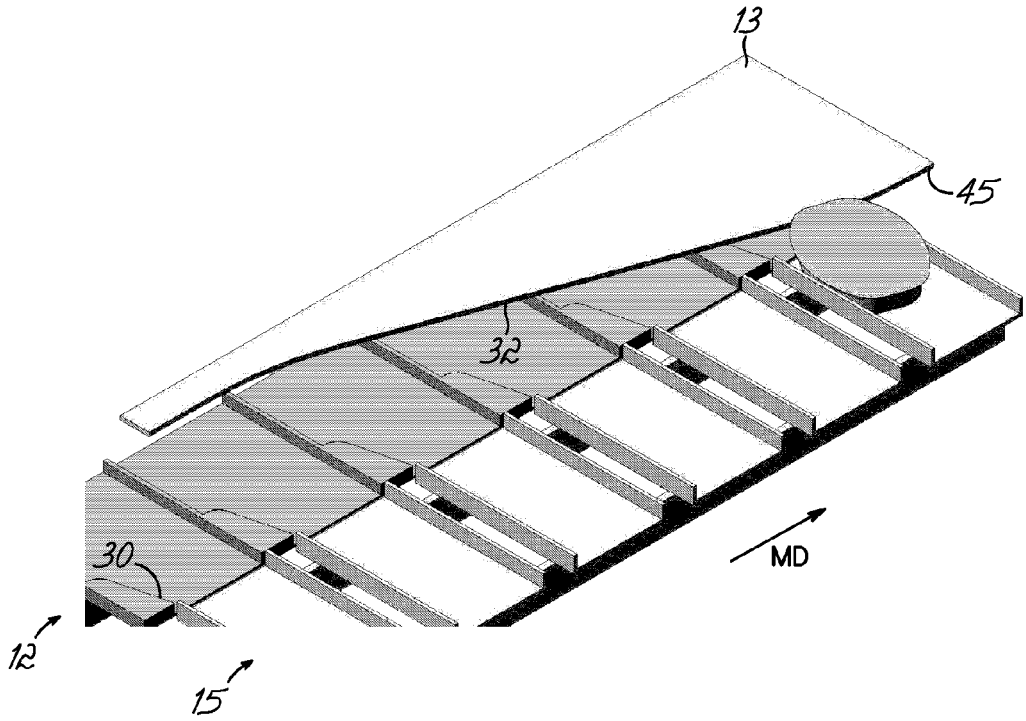
FIGS. 32-34 are diagrammatic illustrations similar to the FIGS. 22-31 with "A" prefixes but showing the final stages of the sequential turning and loading into buckets steps after that shown in FIG. 31A.
Figure 33:
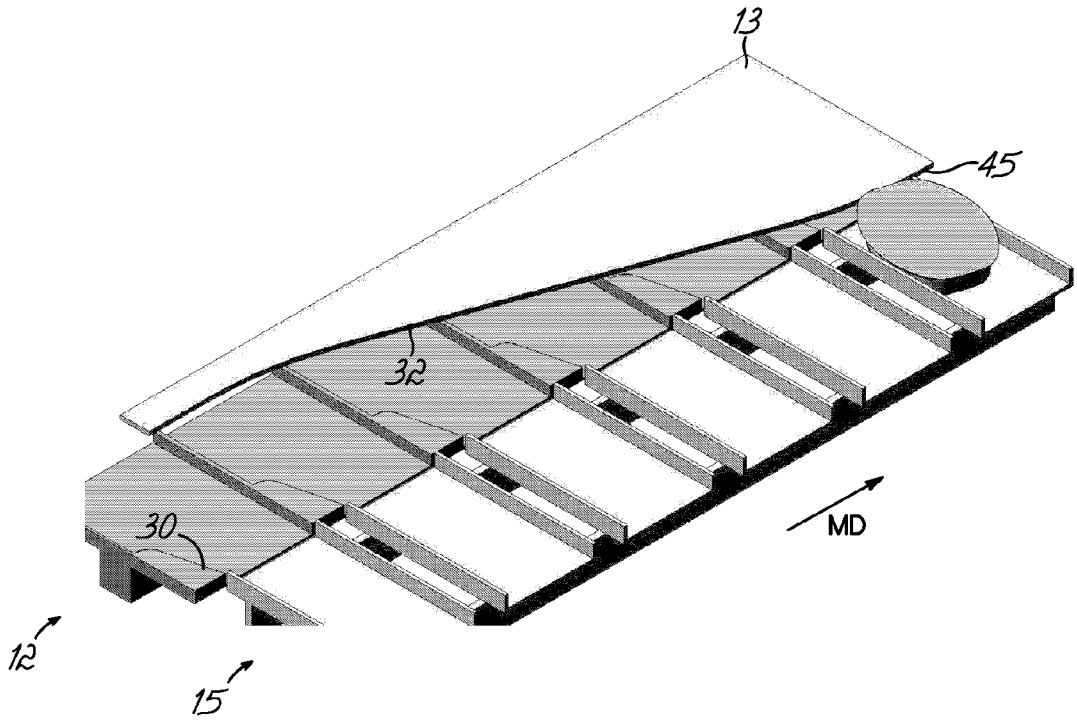
Figure 34:
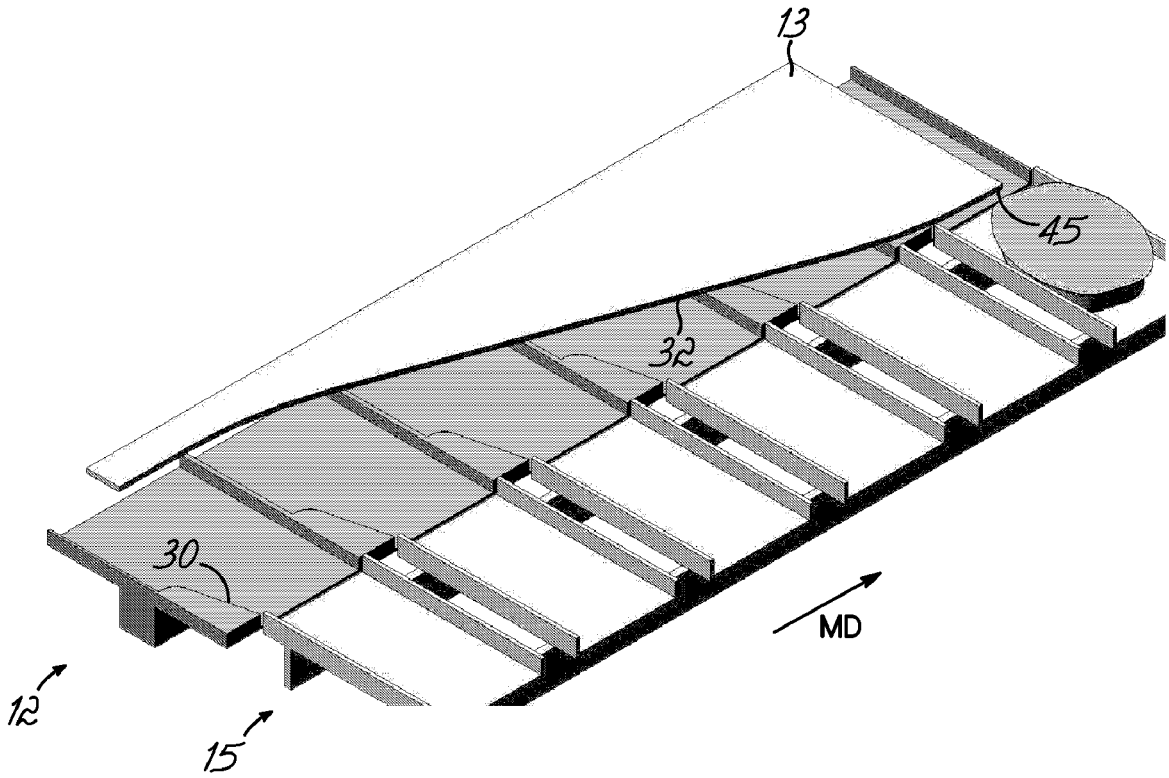

FIGS. 19-34 illustrate diagrammatically various progression of one illustrative tray between initial engagement with the turning guide 13 and final transfer near guide end 45, with FIGS. 20 and 21 showing intermediate turning and near final insertion of trays onto bucket conveyor 15 and FIGS. 22-34 showing the progression or sequence from near the initial engagement of the tray with guide surface 32 to final transferred position (FIG. 34). A number of figures have downstream portions of conveyor 12 and bucket conveyor 15 omitted for clarity.

Also, it will be appreciated that, in use, the invention will continuously convey and transfer trays in all positions and buckets (FIGS. 5-7 and 10-17). As shown, the diagrammatic views in FIGS. 19-34 show the progression of only one tray for clarity.

This invention thus provides flat tray cartoning at high speeds in excess of 200 trays per minute and preferably at speeds of 240 to 260 trays per minute or greater, in continuous flow, without abrupt changes in velocity, and with minimal damage or disruption of flow. Elaborate timing is not required. The trays move along a relatively straight vector with inducement only of minimal forces necessary to turn and transfer them.

It will be appreciated that the turning guide and the tray conveyor cam lugs can be varied, depending on the geometry of the product or tray.

These and other modifications and variations of the invention will be readily appreciated by the foregoing to those of ordinary skill in the art without departing from the scope of the invention and applicant intends to be bound only by the claims appended hereto,

What is claimed is:

1. Apparatus for cartoning flat trays and including:

a first tray conveyor having leading and trailing lugs defining tray receiving spaces therebetween and oriented to convey trays in a first direction;

a cam surface on a trailing lug defining a tray pivot; and a turning guide oriented for engagement with trays on said first product conveyor and having a guide surface for engaging said trays as they are transported by said first conveyor, said turning guide turning said trays and urging said trays against said cam surface and in a second direction at an angle to said first direction.

2. Apparatus as in claim 1 further including a tray bucket conveyor operatively oriented alongside at least a portion of said first tray conveyor and having at least one bucket for receiving a tray turned and pushed therein by said turning guide.

3. Apparatus as in claim 2 wherein said bucket of said bucket conveyor has a leading wall and a trailing wall, said leading wall inclined toward said trailing wall from a side receiving said tray to another side thereof.

4. Apparatus as in claim 1 wherein said cam surface is disposed on said trailing lug opposite said turning guide.

5. Apparatus as in claim 1 further including a hold-down guide disposed over trays on said first tray conveyor.

6. Apparatus as in claim 1 including a carton conveyor operably disposed adjacent said first tray conveyor for receiving trays urged therein by said turning guide.

7. Apparatus as in claim 1 including tray pressure relief apparatus upstream of said first tray conveyor.

8. Apparatus as in claim 7 wherein said tray pressure relief apparatus comprises opposed star wheels.

9. Apparatus as in claim 1 including indexing apparatus disposed upstream of said first tray conveyor for indexing trays onto said first tray conveyors.

10. Apparatus as in claim 1 wherein said trays are elongated and are introduced into said first tray conveyor narrow end leading, and further including a bucket conveyor adjacent said first tray conveyor, said trays being turned by said turning guide for introduction onto said bucket conveyor with narrow end of said trays leading onto said bucket conveyor.

11. Apparatus as in claim 1 further including a carton conveyor disposed adjacent said first tray conveyor, for receiving said trays into cartons on said carton conveyor directly from said first tray conveyor.

12. A method of cartoning elongated trays with opposed narrow ends into cartons and the method comprising the steps of.

introducing trays with narrow ends leading onto a first tray conveyor with said tray oriented between a leading lug and a trailing lug, conveying said trays with narrow ends leading in a first direction;

moving a leading portion of said trays into engagement with an elongated turning guide;

turning said trays about a trailing lug; and pushing said trays with narrow end leading in a second direction.

13. A method as in claim 12 including the further step of:

pushing said trays with said turning guide into buckets on an adjacent bucket conveyor.

14. A method as in claim 12 including the further step of:

pushing said trays with said turning guide into cartons on an adjacent carton conveyor.

15. A method as in claim 12 wherein said trailing lug includes a cam surface and the method further including urging said trays against said cam surface in response to engagement of trays with said turning guide and turning said trays.

16. A method as in claim 12 including feeding trays to said first tray conveyor from a prime of trays and including the further step of relieving pressure on leading tray from pressure of a following tray prior to introduction of the leading tray onto said first tray conveyor.

17. A method as in claim 16 including the step of indexing trays at a predetermined pitch onto said first tray conveyor.

* * * * *